US012654084B2

(12) United States Patent
Gilman et al.

(10) Patent No.: US 12,654,084 B2
(45) Date of Patent: Jun. 16, 2026

(54) SKI INSTRUCTION AND SIMULATION DEVICE AND METHODS OF USING SAME

(71) Applicant: Jonathan Gilman, Sherman Oaks, CA (US)

(72) Inventors: Jonathan Gilman, Sherman Oaks, CA (US); James Mielke, San Jose, CA (US); Gijs Ijpma, Montreal (CA); Simon Francis Cooke, Montreal (CA)

(73) Assignee: Jonathan Gilman, Sherman Oaks, CA (US)

( * ) Notice: Subject to any disclaimer, the term of this patent is extended or adjusted under 35 U.S.C. 154(b) by 0 days.

(21) Appl. No.: 18/926,177

(22) Filed: Oct. 24, 2024

(65) Prior Publication Data

US 2026/0115562 A1 Apr. 30, 2026

(51) Int. Cl.
*A63B 69/18* (2006.01)
*A63B 71/06* (2006.01)

(52) U.S. Cl.
CPC ..... *A63B 69/18* (2013.01); *A63B 71/0622* (2013.01); *A63B 2071/0647* (2013.01); *A63B 2220/05* (2013.01); *A63B 2220/16* (2013.01); *A63B 2220/20* (2013.01); *A63B 2220/807* (2013.01)

(58) Field of Classification Search
CPC ..... A63B 69/18; A63B 71/0622; A63B 2071/0647; A63B 2220/05; A63B 2220/16; A63B 2220/20; A63B 2220/807
See application file for complete search history.

(56) References Cited

U.S. PATENT DOCUMENTS 5,049,079 A 9/1991 Furtado et al.
5,328,427 A 7/1994 Sleamaker
(Continued)

FOREIGN PATENT DOCUMENTS

CN 102974085 A 3/2013
CN 113 318 414 A 8/2021
(Continued)

OTHER PUBLICATIONS

Skiingsolo. "I Tried An Olympic-Caliber Ski Simulator, And It Rocked!", Unofficial Networks, Oct. 12, 2023, https://unofficialnetworks.com/2023/10/12/lemon-lodge-ski-simulator/. Accessed Aug. 21, 2024.
(Continued)

*Primary Examiner* — Robert P Bullington
(74) *Attorney, Agent, or Firm* — Knobbe, Martens, Olson & Bear LLP

(57) ABSTRACT

Disclosed herein are embodiments of a ski simulation and training device that can include a base support assembly, a left and right foot support unit adapted to receive and support a user's left and right foot, respectively. The foot support units are translatable relative to the base support assembly in at least two directions so that the user can move his or her left foot in the at least two directions about the base support assembly in at least two directions. Further, in some embodiments, the foot support portions can be rotatable relative to the base support assembly so that the user can rotate his or her left foot in a clockwise or counterclockwise direction relative to the base support assembly. In some embodiments, the foot supports can also be tilted so that the user can tilt his or her feet relative to the base assembly.

20 Claims, 21 Drawing Sheets

(56) References Cited

U.S. PATENT DOCUMENTS

| | | | |
|---|---|---|---|
| 8,612,181 | B2 | 12/2013 | Czaja et al. |
| 9,968,840 | B2 | 5/2018 | Czaja et al. |
| 11,052,288 | B1 | 7/2021 | Berme et al. |
| 11,172,331 | B2 | 11/2021 | Czaja et al. |
| 11,328,620 | B2 | 5/2022 | Grant et al. |
| 11,367,364 | B2 | 6/2022 | May |
| 11,832,931 | B2 | 12/2023 | Czaja et al. |
| 11,996,002 | B2 | 5/2024 | Grant et al. |
| 2022/0230556 | A1 | 7/2022 | Grant et al. |
| 2024/0060842 | A1 | 2/2024 | Czaja et al. |
| 2024/0274031 | A1 | 8/2024 | Grant et al. |

FOREIGN PATENT DOCUMENTS

| | | | |
|---|---|---|---|
| CN | 107233718 | B | 4/2023 |
| CN | 116850566 | A | 10/2023 |
| EP | 3295447 | A2 | 3/2018 |
| KR | 101317012 | B1 | 10/2013 |
| RU | 2728086 | C1 | 7/2020 |
| TW | M 634 881 | U | 12/2022 |
| WO | WO 97/24163 | A1 | 7/1997 |
| WO | WO 2016/185290 | A2 | 11/2016 |
| WO | WO 2018/012394 | A1 | 1/2018 |
| WO | WO 2024/144727 | A1 | 7/2024 |

OTHER PUBLICATIONS

PCT International Search Report and Written Opinion for Int'l Application No. PCT/US2025/052308 dated Feb. 17, 2026 in 21 pages.

SKI INSTRUCTION AND SIMULATION DEVICE AND METHODS OF USING SAME

BACKGROUND

Field of the Disclosure

Embodiments of the present disclosure relate to devices, apparatuses, and methods for simulating and/or instructing skiing.

Description of the Related Art

Skiing down a snow-covered mountain is a glorious feeling, if you know how to confidently maneuver the two oversized planks bound to your feet. Until one can confidently turn and stop on skis, there is no glory. Fear of falling, or speeding down the hill, losing control and crashing into something, or someone, is unfortunately not the exception but the rule for the novice skier.

Ski lessons for the new skier always begin with a straight run, gliding wedge, breaking wedge and wedge turns on a relatively flat slope. Linking turns and controlling speed grants access to more runs.

Many people experience their first and last day of skiing all within a few hours. There are just too many variables beyond one's control that can lead to a miserable day on the hill. Unfamiliar, awkward equipment and clothing, along with potentially challenging weather conditions, can be problematic while attempting to learn. Inconsistencies in ski instructors' abilities to communicate with students, especially the younger ones (3-5 years of age), create more challenges for early ski education. A better approach to instructing and learning to ski is needed.

SUMMARY OF SOME EXAMPLE EMBODIMENTS

Providing a user with a simulated skiing experience can greatly improve the user's ski skills in a safe and comfortable environment. This can be done without exposing the user to the risks and potential elements of a crowded, outdoor ski slope.

The devices, systems, and methods described in this disclosure each have several innovative aspects, implementations, or aspects, no single one of which is solely responsible for the desirable attributes disclosed herein.

Disclosed herein are embodiments of a ski simulation and training device. In some embodiments, the device can include a base support assembly that can include a left base portion and a right base portion, a left foot support unit adapted to receive and support a user's left foot, a right foot support unit adapted to receive and support a user's right foot. In some embodiments, the left foot support unit is adapted to move independently of the right foot support unit, the left foot support unit is translatable (e.g., can be moved) relative to the left base portion in at least two directions about an upper support surface of the left base portion so that the user can move his or her left foot in the at least two directions about the upper support surface of the left base portion and the right foot support unit is translatable (e.g., can be moved) relative to the right base portion in at least two directions about an upper support surface of the right base portion so that the user can move his or her right foot in the at least two directions about the upper support surface of the right base portion. Further, in some embodiments, the left foot support portion can be rotatable relative to the left base portion so that the user can rotate his or her left foot in a clockwise or counter-clockwise direction relative to the left base portion and the right foot support portion can be rotatable relative to the right base portion so that the user can rotate his or her right foot in a clockwise or counter-clockwise direction relative to the right base portion.

In any embodiments disclosed herein, the left foot support portion can also be tiltable so that the user can tilt his or her left foot in a leftward direction or in a rightward direction relative to a plane that is perpendicular to the upper support surface of the left base portion and the right foot support portion can be tiltable so that the user can tilt his or her right foot in a leftward direction or in a rightward direction relative to a plane that is perpendicular to the upper support surface of the right base portion.

In any embodiments of the device disclosed herein can also include a position measuring unit, a computing device, and a video display. In some embodiments, the position measuring unit can be adapted to, in an operable state, collect data that can be used by the computing device to determine at least the following: a distance that the user's left foot can be spaced apart in a lateral direction from the user's right foot, a rotational orientation of the user's left foot (e.g., a measure of how much the user's left foot has rotated or twisted relative to a reference orientation, such as a perfectly straight orientation perfectly aligned with the user's direction of travel), and/or a rotational orientation of the user's right foot (e.g., a measure of how much the user's right foot has rotated or twisted relative to a reference orientation, such as a perfectly straight orientation perfectly aligned with the user's direction of travel).

In some embodiments, the position measuring unit can also be adapted to, in an operable state, collect data that can be used by the computing device to determine at least the following: a tilt angle of the user's left foot relative to the plane that can be perpendicular to the upper support surface of the left base portion (e.g., a measure of how much the user's left foot or left lower leg can be leaning in a lateral direction relative to a perfectly upright position, i.e., how much the user's left foot or the left lower leg has rotated about a second axis that can be parallel to the upper support surface of the left foot support unit and that can be in the same direction as a length of the user's left foot) and a tilt angle of the user's right foot relative to the plane that can be perpendicular to the upper support surface of the right base portion (e.g., a measure of how much the user's right foot or right lower leg can be leaning in a lateral direction relative to a perfectly upright position, i.e., how much the user's right foot or right lower leg has rotated about a second axis that can be parallel to the upper support surface of the right foot support unit and that can be in the same direction as a length of the user's right foot). Further, in some embodiments, the computing device can be adapted to determine at least the following using the data from the position measuring unit: the distance that the user's left foot can be spaced apart in a lateral direction from the user's right foot, the rotational orientation and the tilt angle of the user's left foot, and the rotational orientation and the tilt angle of the user's right foot.

Any embodiments of the devices, systems, and methods disclosed herein can include, in additional embodiments, one or more or any combination of the following features, components, and/or details, in any combination with any of the other features, components, and/or details of any other embodiments disclosed herein: wherein the computing device can be adapted to cause the video display to display a visual depiction of at least a portion of a left ski and a portion of a right ski; wherein the computing device can be adapted to illustrate a visual depiction of the rotational orientation and the tilt angle of the user's left foot and the user's right foot on the video display; wherein the computing device can be adapted to illustrate a visual depiction on the video display of a first virtual object, such as a ski or a portion of a ski, in a rotational orientation and a tilt angle that corresponds to the rotational orientation and the tilt angle of the user's left foot or the user's right foot and a second virtual object, such as a ski or a portion of a ski, in a rotational orientation and a tilt angle that corresponds to the rotational orientation and the tilt angle of the other of the user's left foot or the user's right foot; wherein the computing device can be adapted to cause the video display to display a visual depiction that can include at least a portion of a left ski that moves in response to and can be consistent with a movement of the user's left foot and right ski that moves in response to and consistent with a movement of the user's right foot; and/or wherein the computing device can be adapted to cause the video display to display a visual depiction that can include at least a portion of a left ski in a rotational orientation and a tilt angle that corresponds to the rotational orientation and the tilt angle of the user's left foot and that can include at least a portion of a right ski in a rotational orientation and a tilt angle that corresponds to the rotational orientation and the tilt angle of the user's left foot.

Any embodiments of the devices, systems, and methods disclosed herein can include, in additional embodiments, one or more or any combination of the following features, components, and/or details, in any combination with any of the other features, components, and/or details of any other embodiments disclosed herein: wherein the video display depicts at least the portion of a left ski in a rotational orientation that simulates the rotational orientation of the user's left foot, the computing device depicts at least a portion of the right ski in a rotational orientation that simulates the rotational orientation of the user's right foot, and the computing device depicts at least the portion of the left ski at a distance from at least the portion of the right ski that corresponds to the distance that the user's left foot can be spaced apart in the lateral direction from the user's right foot; wherein the video display depicts at least the portion of the left ski at a tilt angle that simulates the tilt angle of the user's left foot or left lower leg, and the computing device depicts at least the portion of the right ski at a tilt angle that simulates the tilt angle of the user's right foot or right lower leg; wherein the computing device can be adapted to cause the video display to display a visual depiction of a ski run with at least a portion of a left ski and a right ski skiing down the ski run, wherein the at least the portion of the left ski simulates a movement of an actual ski that performs in a way that can be consistent with a movement and an orientation of the user's left foot and wherein the at least the portion of the right ski simulates a movement of an actual ski that performs in a way that can be consistent with a movement and an orientation of the user's right foot; wherein the computing device can be adapted to cause the video display to display a visual depiction of a ski run having snow and ski gates; wherein the computing device can be adapted to illustrate a visual depiction on the video display of the left ski or a portion of a left ski and a right ski or a portion of the right ski and a plurality of gates or objects for the user to simulate skiing around, wherein the gates or objects are color coded so that gates or objects on a left side of the ski run have a first color that matches the right ski and so that gates or objects on a right side of the ski run have a second color that matches the left ski, wherein the first color can be different than the second color; wherein the computing device can be adapted to cause the video display to display a visual depiction of a target for the user to follow; and/or wherein the computing device can be adapted to cause the video display to display a visual depiction of a model pair of skis or a model portion of a pair of skis for the user to try to match a movement of.

Any embodiments of the devices, systems, and methods disclosed herein can include, in additional embodiments, one or more or any combination of the following features, components, and/or details, in any combination with any of the other features, components, and/or details of any other embodiments disclosed herein: wherein the left base portion can be separate from and independently movable relative to the right base portion so that the left base portion can be moved relative to the right base portion and/or spaced apart from the right base portion; wherein the left base portion can be adapted to limit a movement of the left foot support unit in the fore direction and the aft direction and in a second lateral direction so that a user can only move his or her left foot in the fore direction and the aft direction and in the second lateral direction within a limited range and wherein the right base portion can be adapted to limit a movement of the right foot support unit in the fore direction and the aft direction and in a second lateral direction so that a user can only move his or her right foot in the first fore and aft direction and in the second lateral direction to a limited extent; wherein the left base portion can be adapted to limit a movement of the left foot support unit in a fore and aft direction to within a four inch or approximately four inch range, or a six inch or approximately six inch range, or an eight inch or approximately eight inch range, or a ten inch or approximately ten inch range, or a twelve inch or approximately twelve inch range, or from a four inch or approximately four inch range to a ten inch or approximately ten inch range, or from a six inch or approximately six inch range to a ten inch or approximately ten inch range, or of any value, approximately value, or range of values of the foregoing ranges; wherein the right base portion can be adapted to limit a movement of the right foot support unit in a fore and aft direction to within a four inch or approximately four inch range, or a six inch or approximately six inch range, or an eight inch or approximately eight inch range, or a ten inch or approximately ten inch range, or a twelve inch or approximately twelve inch range, or from a four inch or approximately four inch range to a ten inch or approximately ten inch range, or from a six inch or approximately six inch range to a ten inch or approximately ten inch range, or of any value, approximately value, or range of values of the foregoing ranges; wherein the left base portion can be adapted to limit a movement of the left foot support unit in a left and right lateral direction to within a four inch or approximately four inch range, or a six inch or approximately six inch range, or an eight inch or approximately eight inch range, or a ten inch or approximately ten inch range, or a twelve inch or approximately twelve inch range, or from a four inch or approximately four inch range to a ten inch or approximately ten inch range, or from a six inch or approximately six inch range to a ten inch or approximately ten inch range, or of any value, approximately value, or range of values of the foregoing ranges, and the right base portion can be adapted to limit a movement of the right foot support unit in a left and right lateral direction to within a four inch or approximately four inch range, or a six inch or approximately six inch range, or an eight inch or approximately eight inch range, or a ten inch or approximately ten inch range, or a twelve inch or approximately twelve inch range, or from a four inch or approximately four inch range to a ten inch or approximately ten inch range, or from a six inch or approximately six inch range to a ten inch or approximately ten inch range, or of any value, approximately value, or range of values of the foregoing ranges.

Any embodiments of the devices, systems, and methods disclosed herein can include, in additional embodiments, one or more or any combination of the following features, components, and/or details, in any combination with any of the other features, components, and/or details of any other embodiments disclosed herein: wherein the left base portion can include a left base support bottom member and a left base support cover coupled to the left base support bottom member and the right base portion can include a right base support bottom member and a right base support cover coupled to the right base support bottom member; wherein the left base support bottom member has a perimeter wall around a perimeter of the left base support bottom member that can be adapted to limit a range of movement of the left foot support unit in the lateral direction and in the longitudinal direction and wherein the right base support bottom member has a perimeter wall around a perimeter of the right base support bottom member that can be adapted to limit a range of movement of the right foot support unit in the lateral direction and in the longitudinal direction; wherein the left base support bottom member has a planar surface that can include the upper support surface of the left base portion and the right base support bottom member has a planar surface that can include the upper support surface of the right base portion; wherein the left base support bottom member and the right base support bottom member each can include a flange extending away from a top of the perimeter wall thereof that extends away from at least a portion of the perimeter wall; wherein left base portion can include two linear or straight side edges that are parallel with one another and a straight back edge that can be perpendicular to the two linear side edges, and wherein right base portion can include two linear or straight side edges that are parallel with one another and a straight edge that can be perpendicular to the two linear side edges; wherein the left base portion and the right base portion each can include a front edge that can include a curve shaped surface or has a segmented front edge that has a middle segment that can be parallel with the back edge and two angled side segments that are at an acute angle relative to the middle segment (e.g., at an angle that can be 30 degrees or approximately 30 degrees relative to the middle segment, or from 20 degrees or approximately 20 degrees to 40 degrees or approximately 40 degrees relative to the middle segment); wherein the left base support cover can include an opening in a top surface thereof through which a portion of the left foot support unit extends and the right base support cover has an opening in a top surface thereof through which a portion of the right foot support unit extends; wherein the opening in the left base support cover member has an area that can be at least 25% of a surface area of a top surface of the left base support cover and wherein the opening in the right base support cover member has an area that can be at least 25% of a surface area of a top surface of the right base support cover; wherein the opening in the left base support cover member has an area that can be from 25% or approximately 25% to 50% or approximately 50% of a surface area of a top surface of the left base support cover and wherein the opening in the right base support cover member has an area that can be from 25% or approximately 25% to 50% or approximately 50% of the surface area of a top surface of the right base support cover; wherein the left base portion can be mirror image of the right base portion; wherein the left base portion can be two feet or approximately two feet wide by two feet or approximately two feet long and the right base portion can be two feet or approximately two feet wide by two feet or approximately two feet long; wherein the left base portion and the right base portion are made from plastic; wherein the left base portion and the right base portion are adapted to rest directly or indirectly on a ground surface; and/or wherein the base the left base portion and the right base portion each can include a grip pad beneath a bottom surface of the base support bottom member of each of the left base portion and the right base portion.

In some embodiments, as mentioned, the left foot support unit and the right foot support unit can move relative to left base portion and the right base portion, respectively. In some embodiments, the base support assembly can include a single base member having a left side and a right side, the left side and right side being connected or integrally formed. In some embodiments, the base support assembly can include a left base portion and/or a right base portion that are not connected but which are separately movable or positionable on the floor surface. For example and without limitation, if a user prefers more space between their feet (or skis) when their feet are closest together, the left base portion can be spaced apart from the right base portion and, if a user prefers less space between their feet (or skis) when their feet are closest together, the left base portion can positioned adjacent to or against the right base portion, or can be positioned a small distance away from the right base portion.

Any embodiments of the devices, systems, and methods disclosed herein can include, in additional embodiments, one or more or any combination of the following features, components, and/or details, in any combination with any of the other features, components, and/or details of any other embodiments disclosed herein: wherein the at least two directions that the left foot support unit can be adapted to move about the upper support surface of the left base portion include a longitudinal direction and in a lateral direction and the at least two directions that the right foot support unit can be adapted to move about the upper support surface of the right base portion includes the longitudinal direction and in the lateral direction; wherein the longitudinal direction can be in a fore direction (e.g., toward a front end of the left base portion or the right base portion) and an aft direction (e.g., toward a rearward end of the left base portion or the right base portion); wherein the lateral direction can be in a left lateral direction (e.g., toward a left side of the left base portion or the right base portion) and an right lateral direction (e.g., toward a right side of the left base portion or the right base portion); wherein the left foot support unit can be adapted to rotate relative to the upper support surface of the left base portion, said rotation relative to the upper support surface of the left base portion being about an axis that can be perpendicular to the upper support surface of the left base portion and wherein the right foot support unit can be adapted to rotate relative to the upper support surface of the right base portion, said rotation relative to the upper support surface of the right base portion being about an axis that can be perpendicular to the upper support surface of the right base portion; wherein the left foot support unit can be adapted to rotate relative to the upper support surface of the left base portion, said rotation relative to the upper support surface of the left base portion being about an axis that can be perpendicular to the upper support surface of the left base portion and wherein the right foot support unit can be adapted to rotate relative to the upper support surface of the right base portion, said rotation relative to the upper support surface of the right base portion being about an axis that can be perpendicular to the upper support surface of the right base portion; and/or wherein the left foot support unit can be adapted to receive and/or couple with a user's left foot, a user's left shoe, or a user's left ski boot and the right foot support unit can be adapted to receive or couple with a user's right foot, a user's right shoe, or a user's right ski boot.

Any embodiments of the devices, systems, and methods disclosed herein can include, in additional embodiments, one or more or any combination of the following features, components, and/or details, in any combination with any of the other features, components, and/or details of any other embodiments disclosed herein: wherein the left foot support unit can be a mirror image of the right foot support unit; wherein the left foot support unit can include a base plate configured to be supported against the upper support surface of the left base portion and a tilt element coupled to the base plate; wherein the right foot support unit can include a base plate configured to be supported against the upper support surface of the right base portion, and a tilt element coupled to the base plate; wherein the tilt element of the left foot support unit and the right foot support unit can include a tilt base coupled to the base plate of the left foot support unit and a tilting member coupled to the tilt base; wherein the tilt base can include an elongated channel along at least a portion of a length of an upper portion of the tilt base; wherein the elongated channel facing generally upwardly when the tilt base can be in an operable position; wherein the elongated channel can include a semi-circular curved surface along a length of the elongated channel; wherein the tilting member has an elongated projection along at least a portion of a length of a lower portion of the tilting member; wherein the elongated channel facing generally downwardly when the tilting member can be in an operable position; wherein the elongated projection can be configured to be received by the elongated channel of the tilt base in an operable position; wherein a shape of the elongated projection can be complementary to a shape of the elongated channel; wherein the elongated projection of the tilting member can be configured to slidably rotate within the elongated channel of the tilt base to permit the tilting member to tilt relative to the tilt base; wherein the tilt element of the left foot support unit and the right foot support unit can be adapted so that the tilting member can only tilt within a predefined angular range relative to the tilt base—for example and without limitation, from a neutral position in which the tilting member can be centered relative to the tilt base; and/or wherein the tilting member can rotate clockwise or counterclockwise to an angle of 30 degrees or approximately 30 degrees relative to the tilt base, or to an angle of 45 degrees or approximately 45 degrees relative to the tilt base, or to an angle of 20 degrees or approximately 20 degrees relative to the tilt base, or to an angle of 10 degrees or approximately 10 degrees relative to the tilt base, or to an angle that can be from 5 degrees or approximately 5 degrees or less to 45 degrees or approximately 45 degrees or more relative to the tilt base, or to an angle that can be from 5 degrees or approximately 5 degrees or less to 30 degrees or approximately 30 degrees or more relative to the tilt base, or to an angle that can be from 5 degrees or approximately 5 degrees or less to 20 degrees or approximately 20 degrees or more relative to the tilt base, or of any value, approximate value, or range of values within any of the foregoing ranges.

Any embodiments of the devices, systems, and methods disclosed herein can include, in additional embodiments, one or more or any combination of the following features, components, and/or details, in any combination with any of the other features, components, and/or details of any other embodiments disclosed herein: wherein the tilt element can include a fastener (e.g., a bolt or a screw) and a bushing that couples the tilting member to the tilt base, the bushing having a female threaded opening therein configured to receive the fastener, wherein the tilt base and the tilting member are between a head of the fastener and the bushing so that, as the fastener can be tightened relative to the bushing, the tilting member can be compressed against the tilt base; wherein the fastener extends through an opening in the tilt base and the tilting member and can be threadedly received by the opening in the bushing; wherein increasing a level of torque between the fastener and the bushing increases a resistance to a movement between the tilting member and the tilt base; wherein the left foot support unit can include a cover plate coupled to the tilt element of the left foot support unit and the right foot support unit can include a cover plate coupled to the tilt element of the right foot support unit; wherein the cover plate can be removable from the tilt element of either of the left foot support unit and the right foot support unit without a use of any tools (e.g., by hand) to permit the interchangeability of the cover plate; wherein the cover plate can be removable but selectively securable (i; e;, lockable) to the tilt element of either of the left foot support unit and the right foot support unit with or without a use of any tools (e.g., by hand) to permit the selectable interchangeability of the cover plate; wherein the tilt element can include one or two (or more) bosses extending in an upward direction when the device can be in an operable position and which are received by one or two (or more) recesses in the cover plate; and/or wherein the left foot support unit also can include a pressure plate coupled to the tilt element of the left foot support unit, the pressure plate of the left support unit being adapted to couple directly to a bottom of the cover plate of the left foot support unit, and the right foot support unit also can include a pressure plate coupled to the tilt element of the right foot support unit, the pressure plate of the right support unit being adapted to couple directly to a bottom of the cover plate of the right foot support unit.

Any embodiments of the devices, systems, and methods disclosed herein can include, in additional embodiments, one or more or any combination of the following features, components, and/or details, in any combination with any of the other features, components, and/or details of any other embodiments disclosed herein: wherein cover plate can include a shoe adapter, which can include a rubber gripping surface; wherein cover plate on each of the left foot support unit and the right foot support unit can include a ski binding configured to couple to a ski boot; wherein cover plate on each of the left foot support unit and the right foot support unit can include a ski binding configured to couple to a ski boot; wherein the left foot support unit can include a mock ski or a portion of a mock ski or a simulated ski or a portion of a simulated ski and the right foot support unit can include a mock ski or a portion of a mock ski or a simulated ski or a portion of a simulated ski; wherein the left foot support unit can include a ski binding on the mock ski or the portion of the mock ski or the simulated ski or the portion of the simulated ski and the right foot support unit can include a ski binding on the mock ski or the portion of the mock ski or the simulated ski or the portion of the simulated ski; wherein the left foot support unit and the right foot support unit each can include a ski binding adapted to receive a ski boot; wherein the left foot support unit can be independently movable relative to the right foot support unit; wherein the left foot support unit can include a sliding base portion adapted to translate about the upper support surface of the left base support and a tilting element coupled to the sliding base portion, the tilting element being adapted to tilt about an axis that can be parallel to the upper support surface of the left base portion; wherein the right foot support unit can include a sliding base portion adapted to translate about the upper support surface of the right base support and a tilting element coupled to the sliding base portion, the tilting element being adapted to tilt about an axis that can be parallel to the upper support surface of the right base portion; wherein the left foot support unit and the right foot support unit each can include one or more pressure sensors configured to gather data related to a pressure or a force that can be applied to the left foot support unit and the right foot support unit; wherein the data related to the pressure or the force that can be applied to the left foot support unit and the right foot support unit can be communicated to the computing device and used to simulate how the user's skis behave on a virtual snow surface; and/or wherein components of the left foot support unit and the right foot support unit other than the fastener are each made from plastic, metal, fiber reinforced plastic, or any combination of the foregoing.

Any embodiments of the devices, systems, and methods disclosed herein can include, in additional embodiments, one or more or any combination of the following features, components, and/or details, in any combination with any of the other features, components, and/or details of any other embodiments disclosed herein: wherein the position measuring unit can include a first marker tag positioned on the left foot support unit, a second marker tag positioned on the right foot support unit, and a camera, wherein the computing device can be adapted to measure the position, the rotational orientation, and the tilt angle of the user's left foot based on a position, a rotational orientation, and a tilt angle of the first marker tag and can be adapted to measure the position, the rotational orientation, and the tilt angle of the user's right foot based on a position, a rotational orientation, and a tilt angle of the second marker tag; wherein the position measuring unit can be further adapted to measure a position of the user's left foot and a position of the user's right foot; wherein the first marker tag can be positioned on a rearward facing surface of the left foot support unit and the second marker tag can be positioned on a rearward facing surface of the right foot support unit; wherein the first marker tag and the second marker tag are fiducial markers; wherein the first marker tag and the second marker tag are ARUCO markers; wherein the position measuring unit can include an optical sensor; wherein the position measuring unit can include a lidar sensor; wherein the position measuring unit can include a time of flight sensor; wherein the position measuring unit can include a laser sensor; wherein the position measuring unit can include a processor with a raspberry pi computing device; and/or wherein the computing device can include a raspberry pi computing device and memory storage device.

Any embodiments of the devices, systems, and methods disclosed herein can include, in additional embodiments, one or more or any combination of the following features, components, and/or details, in any combination with any of the other features, components, and/or details of any other embodiments disclosed herein: wherein the device can include a pair of ski poles; and/or wherein the device can include wax (such as ski wax) covering at least a portion of the upper support surface of the left base portion and the upper support surface of the right base portion.

Also disclosed herein are embodiments of a ski simulation and training device that can include a base support assembly that can include a left base portion and a right base portion, a left foot support unit adapted to receive and support a user's left foot, a right foot support unit adapted to receive and support a user's right foot, a position measuring unit, a computing device, and a video display. In some embodiments, the left foot support unit can be adapted to move independently of the right foot support unit, the left foot support unit can be movable relative to the left base portion in four or more degrees of freedom of movement relative to a ground support surface, and the right foot support unit can be movable relative to the right base portion in four or more degrees of freedom of movement relative to a ground support surface. In some embodiments, the degrees of freedom can include a first degree of freedom, a second degree of freedom, a third degree of freedom, and a fourth degree of freedom. In any embodiments disclosed herein, the first degree of freedom can be a translation or freedom of movement in the lateral direction (e.g., left and right sideways movement) of either or both of the left foot support unit and the right foot support unit relative to the ground support surface, the second degree of freedom can be a translation or freedom of movement in the longitudinal direction (e.g., fore and aft movement) of either or both of the left foot support unit and the right foot support unit relative to the ground support surface, the third degree of freedom can be a rotational degree of freedom or a rotational movement (e.g., twisting) of either or both of the left foot support unit and the right foot support unit about an axis that can be perpendicular to a ground support surface, and/or the fourth degree of freedom can be a rotational degree of freedom or a rotational movement (e.g., tilting) of either or both of the left foot support unit and the right foot support unit about an axis that can be parallel to a ground support surface. In some embodiments, the left foot support unit and the right foot support unit can move independently of one another in any of the degrees of freedom or movement types disclosed herein.

In some embodiments, the left foot support unit can be movable relative to the left base portion in a fifth degree of freedom of movement relative to a ground support surface, wherein the fifth degree of freedom can be a translation or freedom of movement in vertical direction (e.g., an upward movement) of either or both of the left foot support unit and the right foot support unit relative to the ground support surface. In the fifth degree of freedom, the user can lift his or her left foot support unit and/or right foot support unit relative to the ground support surface, or increase or decrease an upward and/or downward force of his or her left foot support unit and/or right foot support surface.

Each of the left foot support unit and the right foot support unit can be adapted to permit three degrees of freedom of movement relative to a ground support surface, or three or more degrees of freedom of movement relative to a ground support surface, or four degrees of freedom of movement relative to a ground support surface, or four or more degrees of freedom of movement relative to a ground support surface, or five degrees of freedom of movement relative to a ground support surface, or five or more degrees of freedom of movement relative to a ground support surface. The foregoing degrees of freedom are collectively referred to herein as degrees of freedom. Therefore, any use of the term degrees of freedom herein can be meant to refer to any of the foregoing numbers of degrees of freedom, i.e., three, three or more, four, four or more, five, five or more degrees of freedom).

In any embodiments disclosed herein, the left foot support unit and the right foot support unit can move independently of one another in any of the degrees of freedom or movement types disclosed herein. In some embodiments, the degrees of freedom include a first degree of freedom, a second degree of freedom, a third degree of freedom, a fourth degree of freedom, and a fifth degree of freedom.

In any embodiments disclosed herein, the first degree of freedom can be a translation or freedom of movement in the lateral direction (e.g., left and right sideways movement) of either or both of the left foot support unit and the right foot support unit relative to the ground support surface.

In some embodiments, the second degree of freedom can be a translation or freedom of movement in the longitudinal direction (e.g., fore and aft movement) of either or both of the left foot support unit and the right foot support unit relative to the ground support surface.

In any embodiments disclosed herein, the third degree of freedom can be a rotational degree of freedom or a rotational movement (e.g., twisting) of either or both of the left foot support unit and the right foot support unit about an axis that can be perpendicular to a ground support surface.

In any embodiments disclosed herein, the fourth degree of freedom can be a rotational degree of freedom or a rotational movement (e.g., tilting) of either or both of the left foot support unit and the right foot support unit about an axis that can be parallel to a ground support surface.

DETAILED DESCRIPTION OF SOME EXAMPLE EMBODIMENTS

Figure 1:
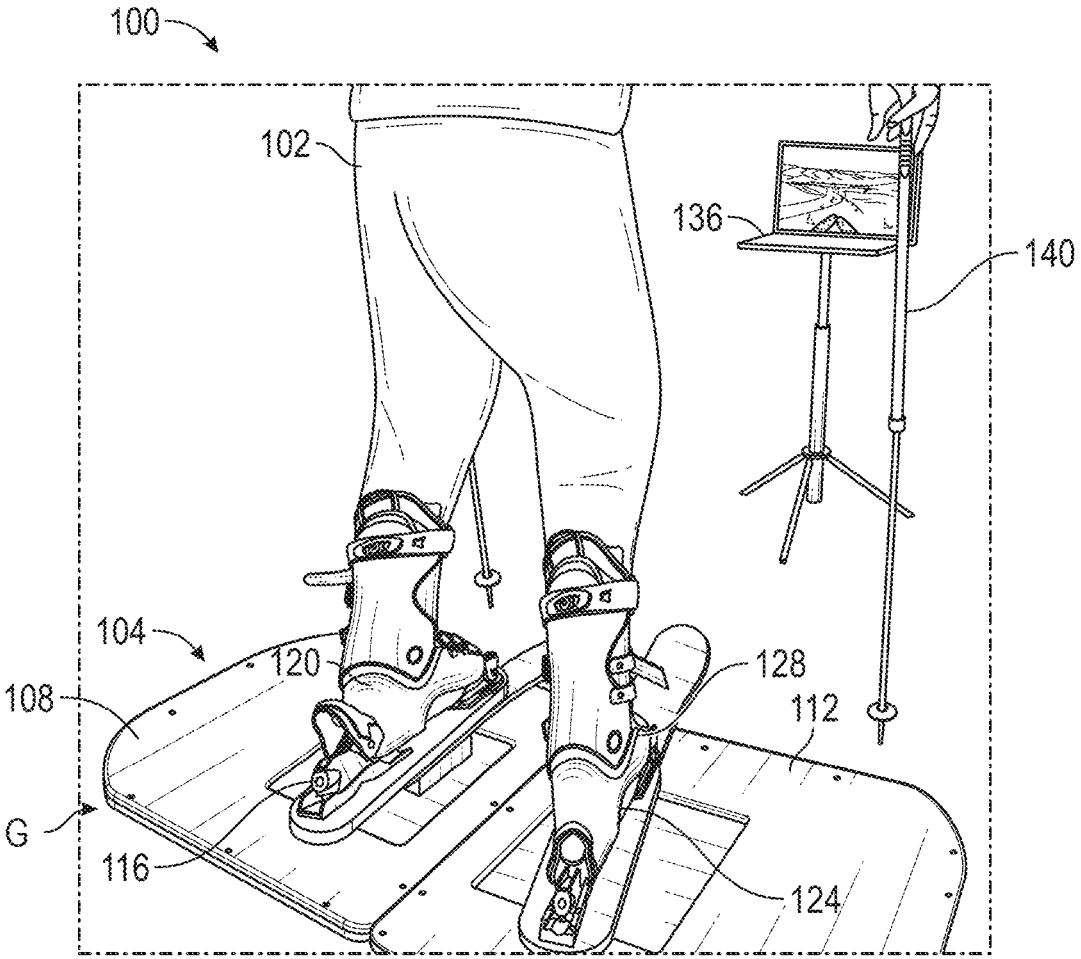
FIG. 1 illustrates a user using an embodiment of a ski simulation and training system.
Figure 2:
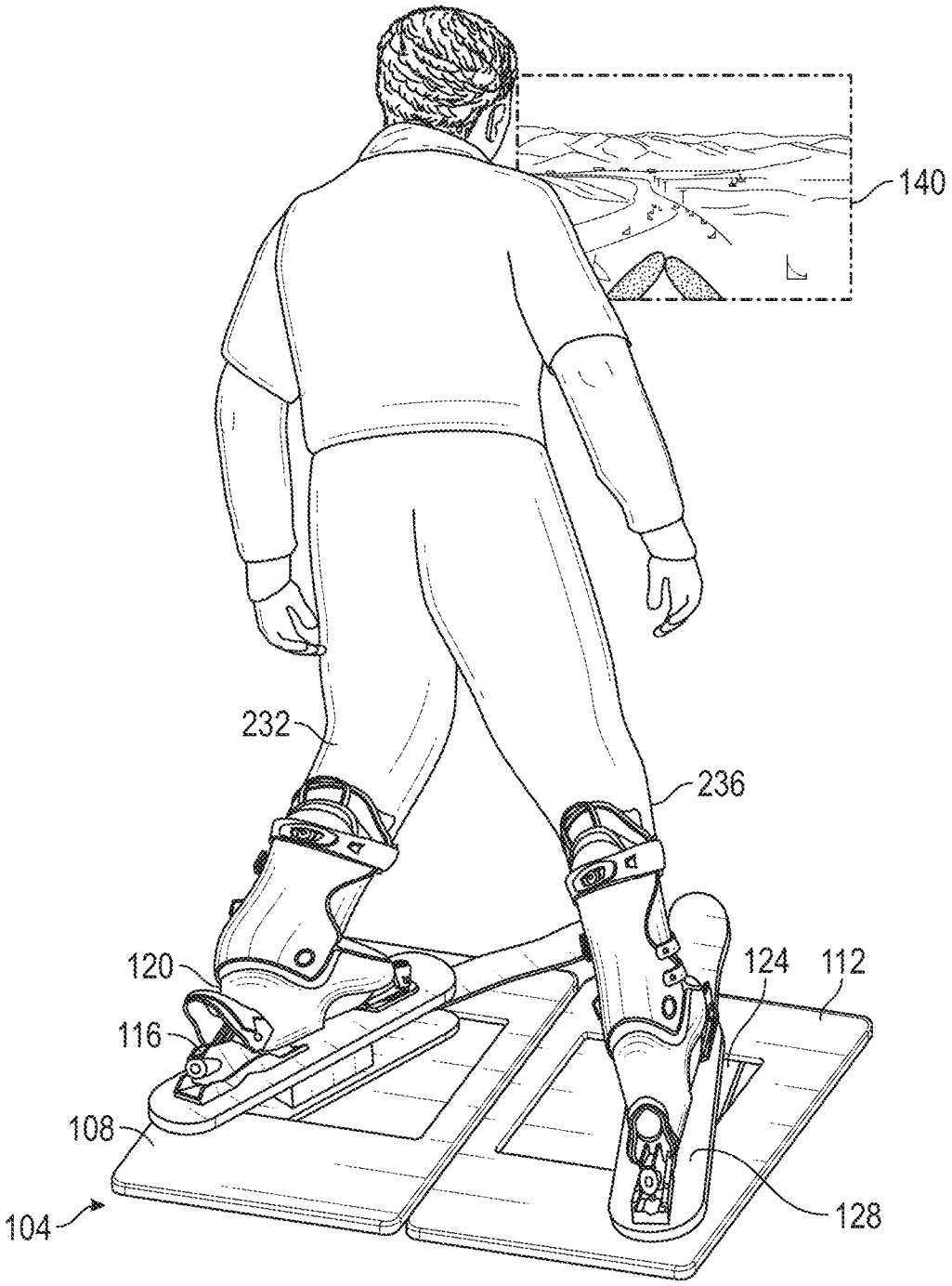
FIG. 2 illustrates a user using an embodiment of a ski simulation and training system.
Figure 3:
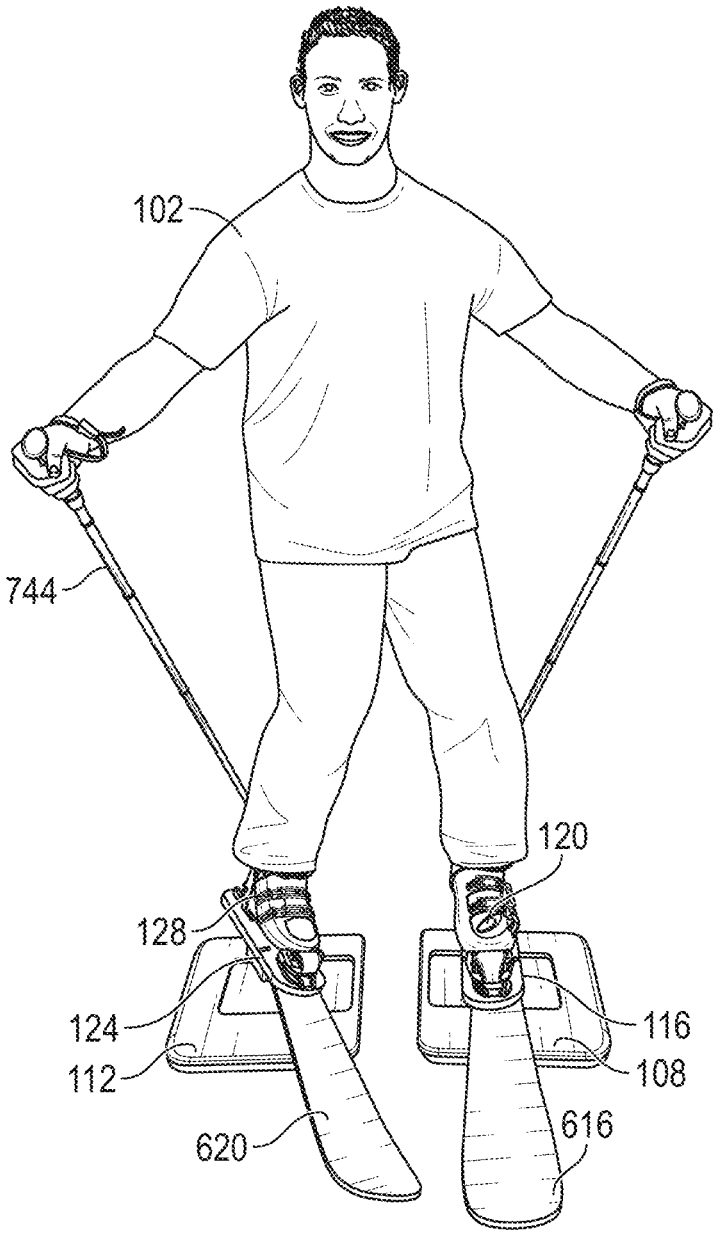
FIG. 3 illustrates a user using an embodiment of a ski simulation and training system.
Figure 4:
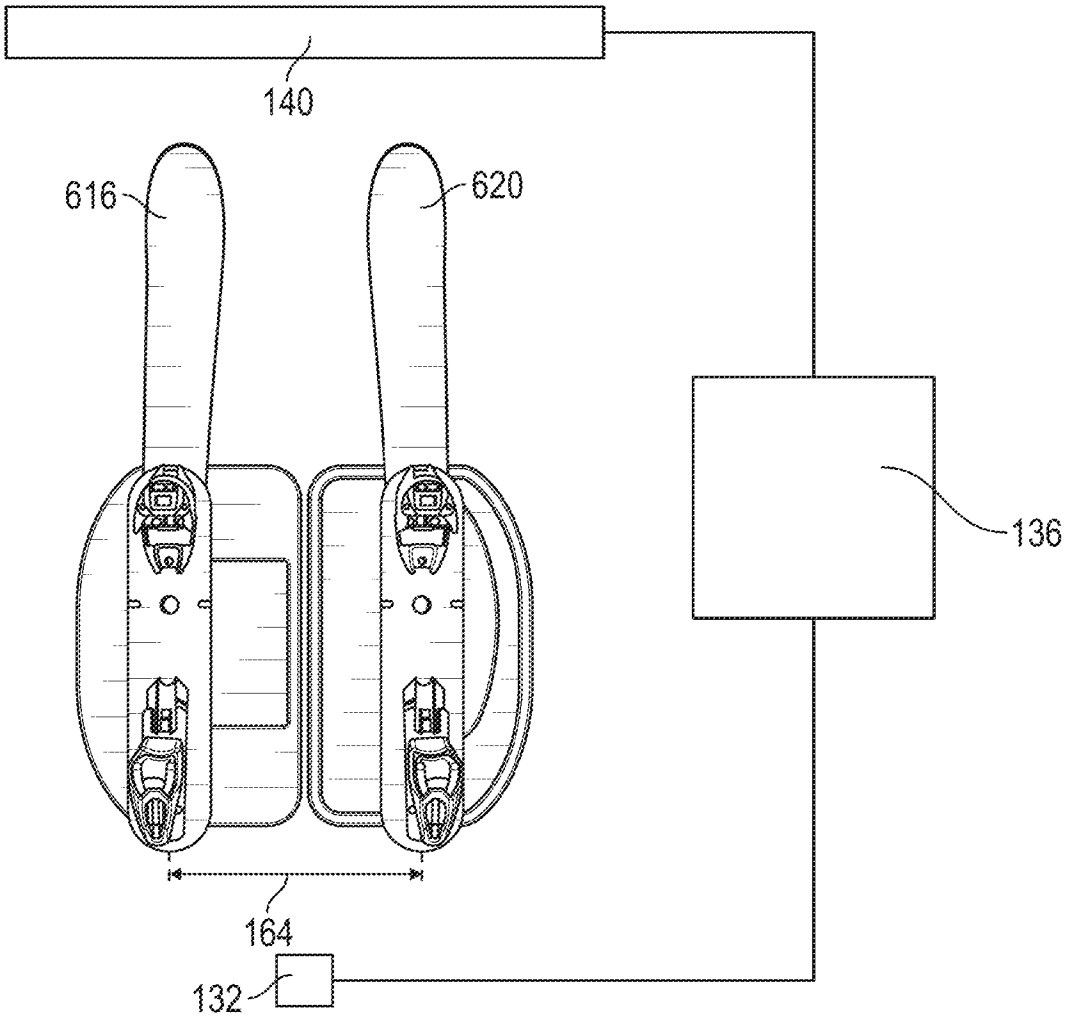
FIG. 4 illustrates a diagram of an embodiment of a ski simulation and training system.
Figure 5:
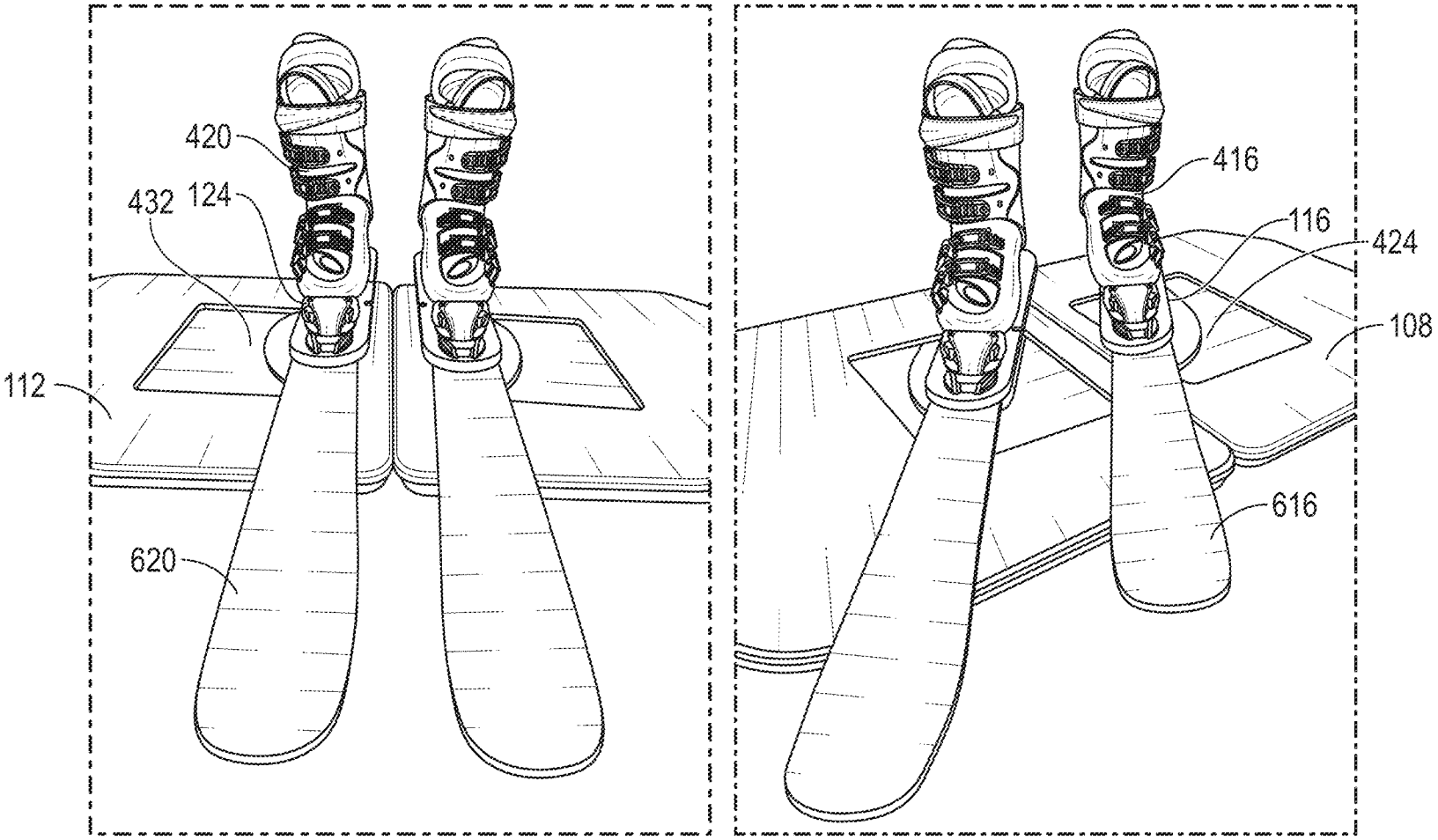
FIG. 5 illustrates an embodiment of a ski simulation and training system with foot support units in multiple positions/orientations.
Figure 6:
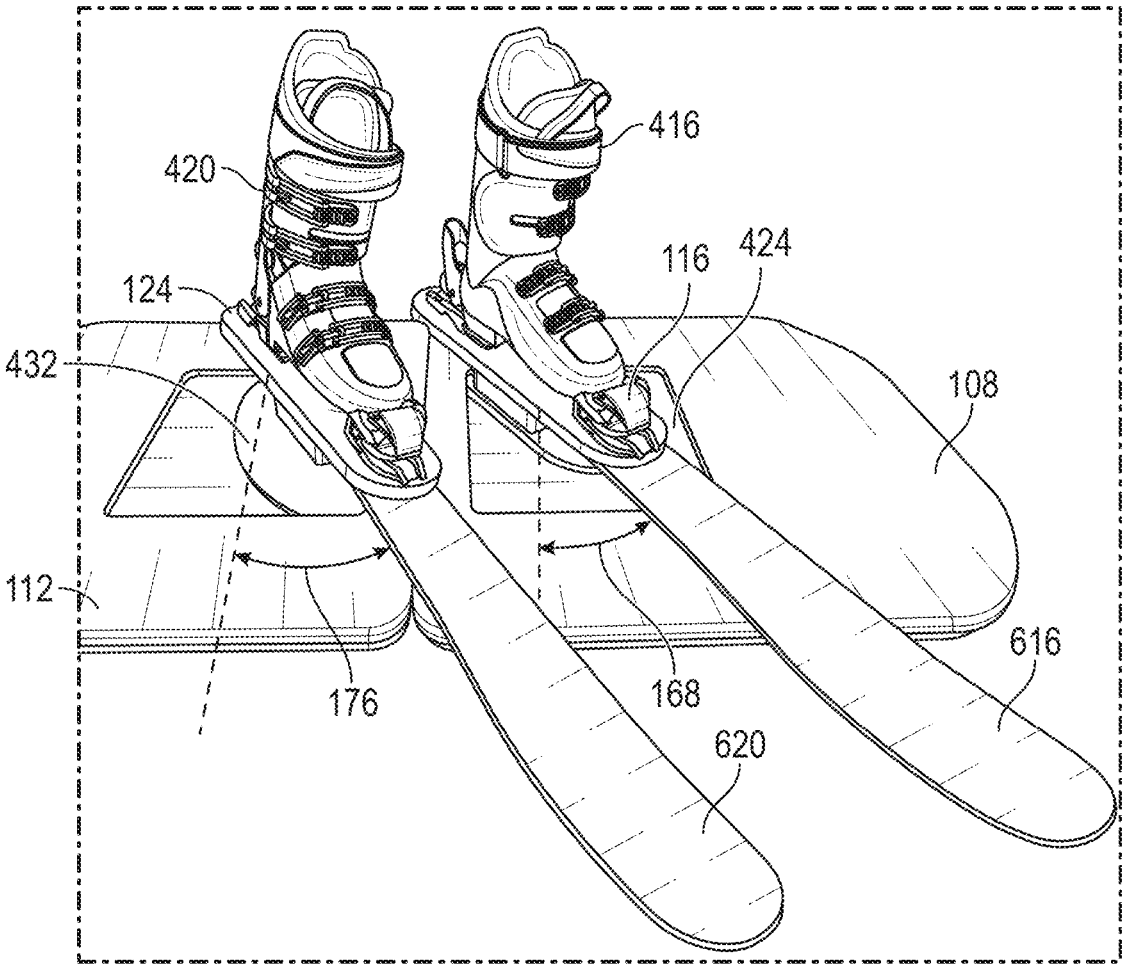
FIG. 6 illustrates an embodiment of a ski simulation and training system with foot support units in a rotated position.
Figure 7:
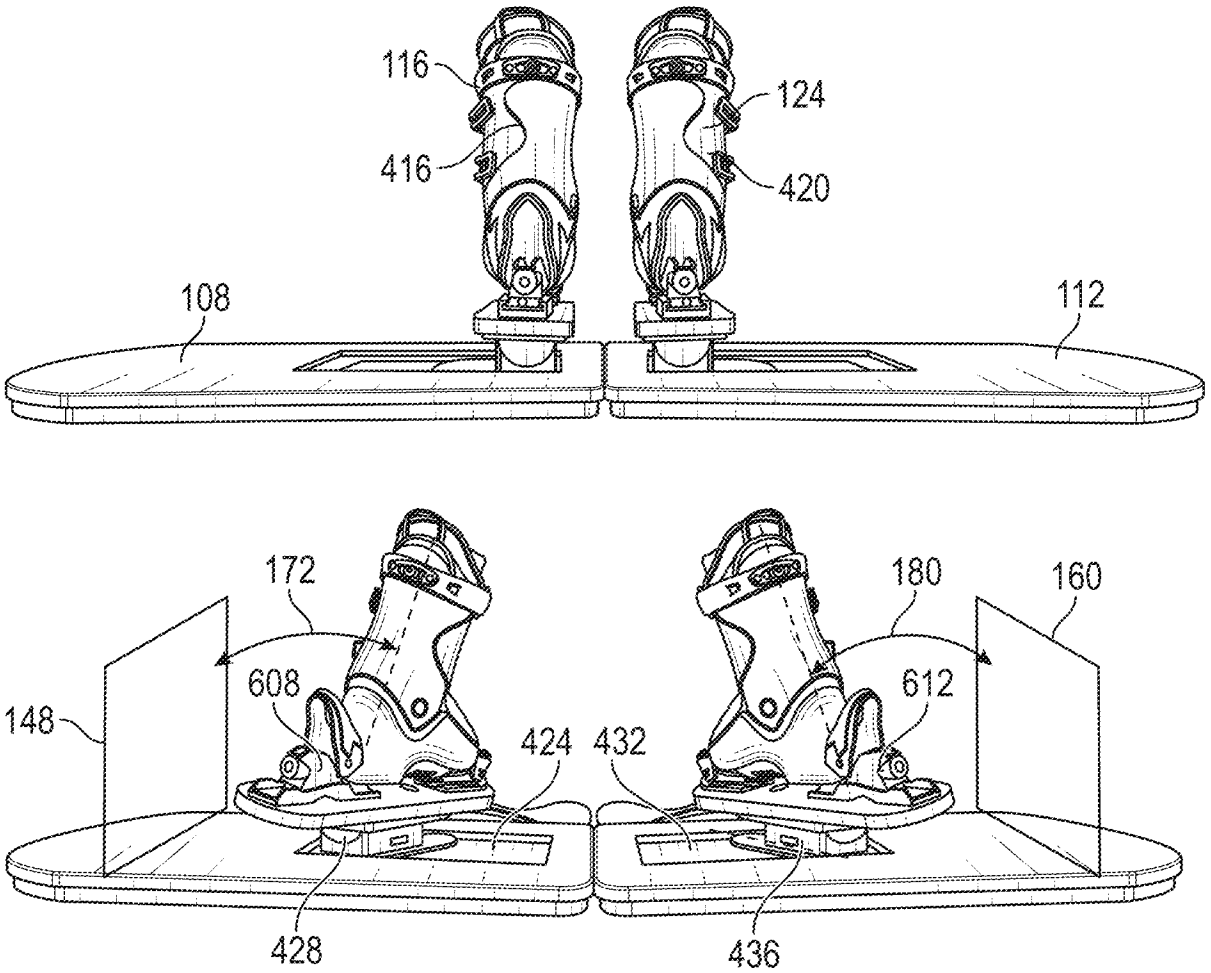
FIG. 7 illustrates an embodiment of a ski simulation and training system with foot support units in a tilted position.
Figure 8:
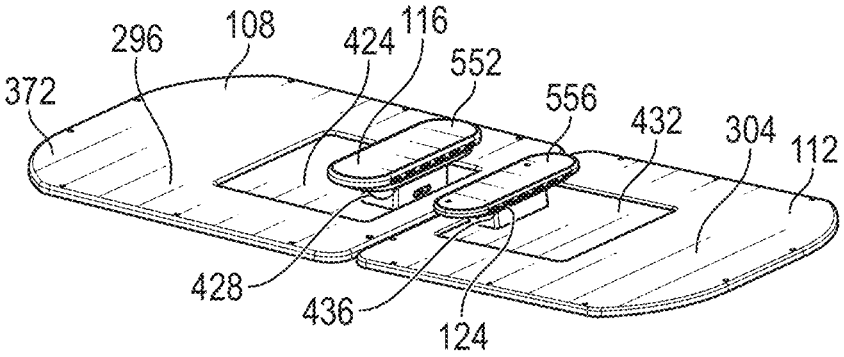
FIG. 8 illustrates left and right base portions and foot support units.
Figure 8:
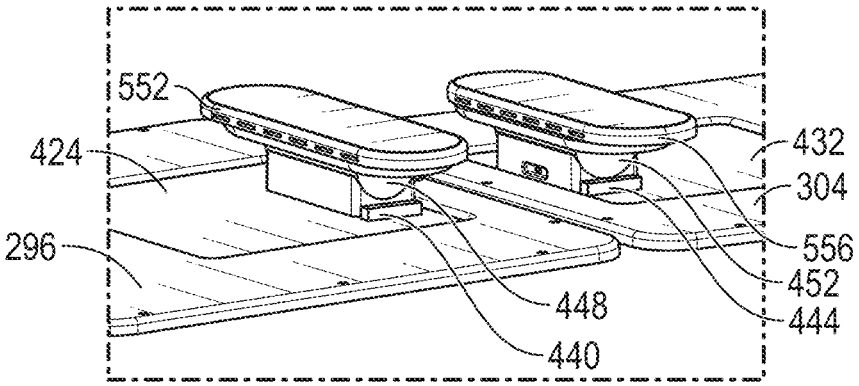
Figure 9:
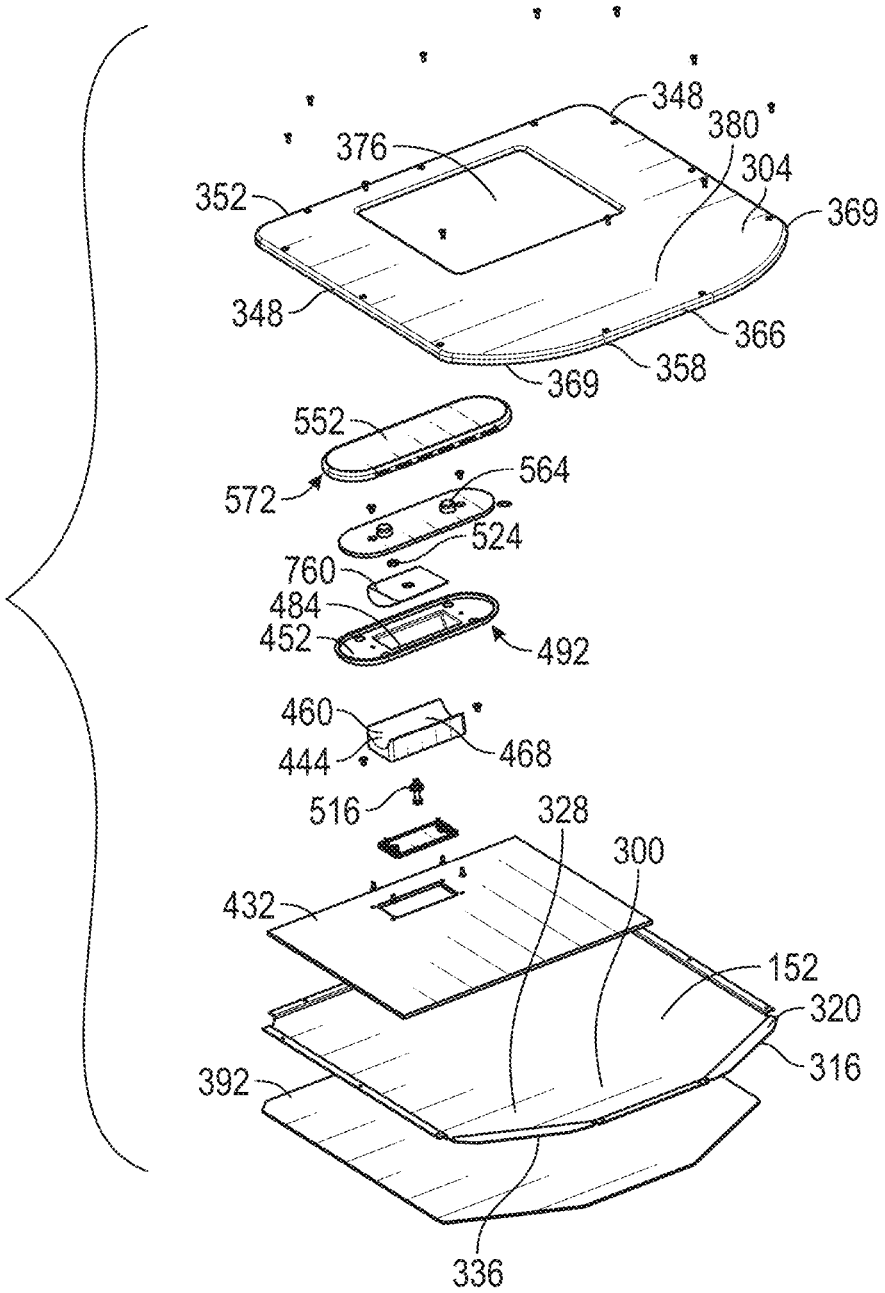
FIG. 9 illustrates an exploded view of a right base portion and foot support unit.
Figure 10:
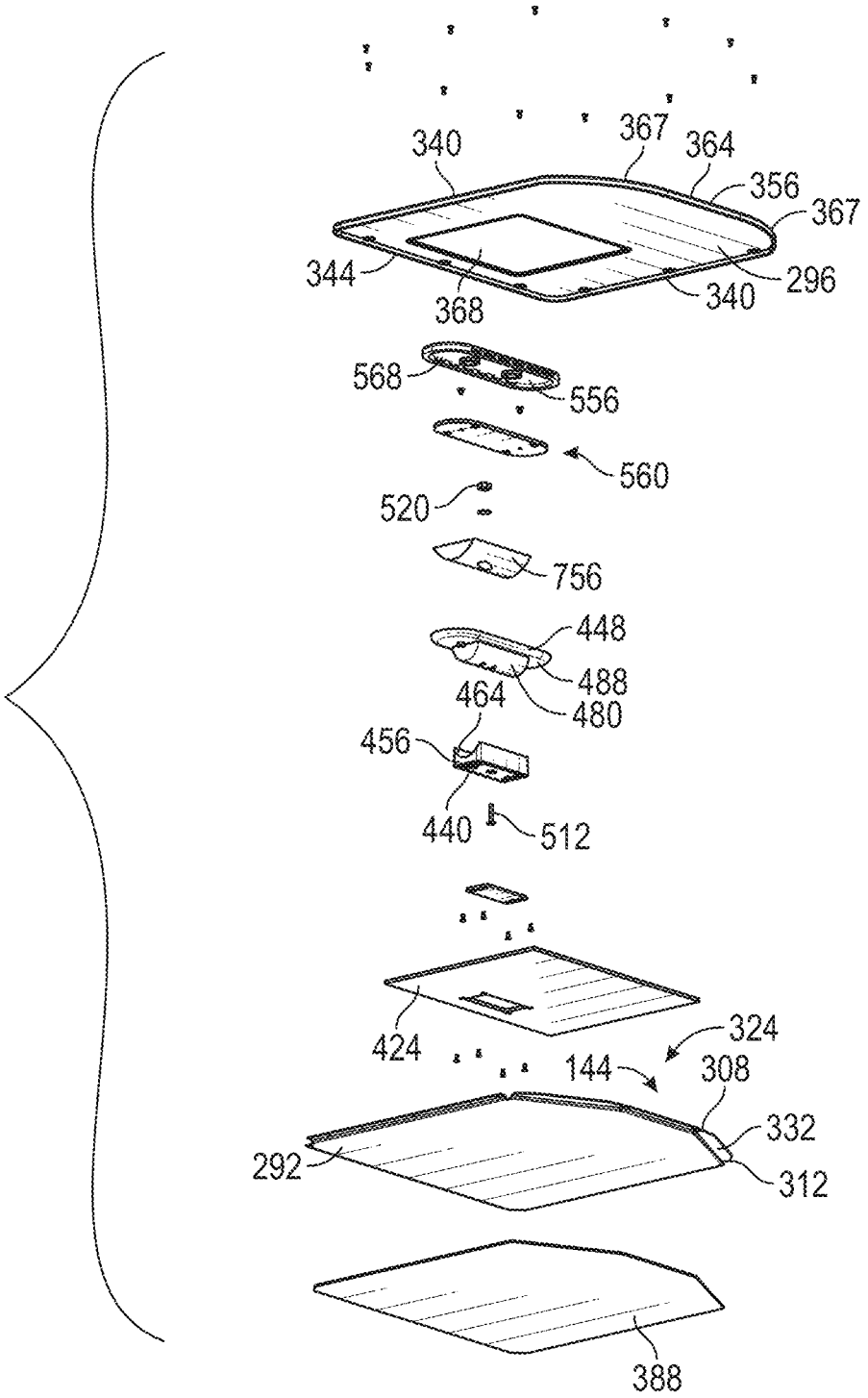
FIG. 10 illustrates an exploded view of a right base portion and foot support unit.
Figure 11:
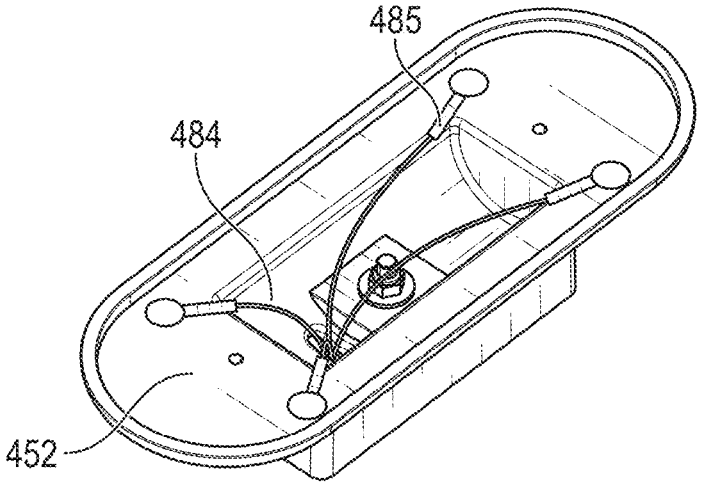
FIG. 11 illustrates a tilt element and a tilt-shaped washer.
Figure 11:
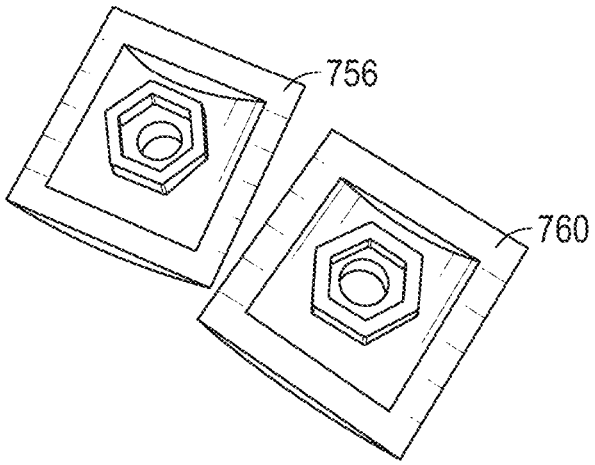
Figure 12:
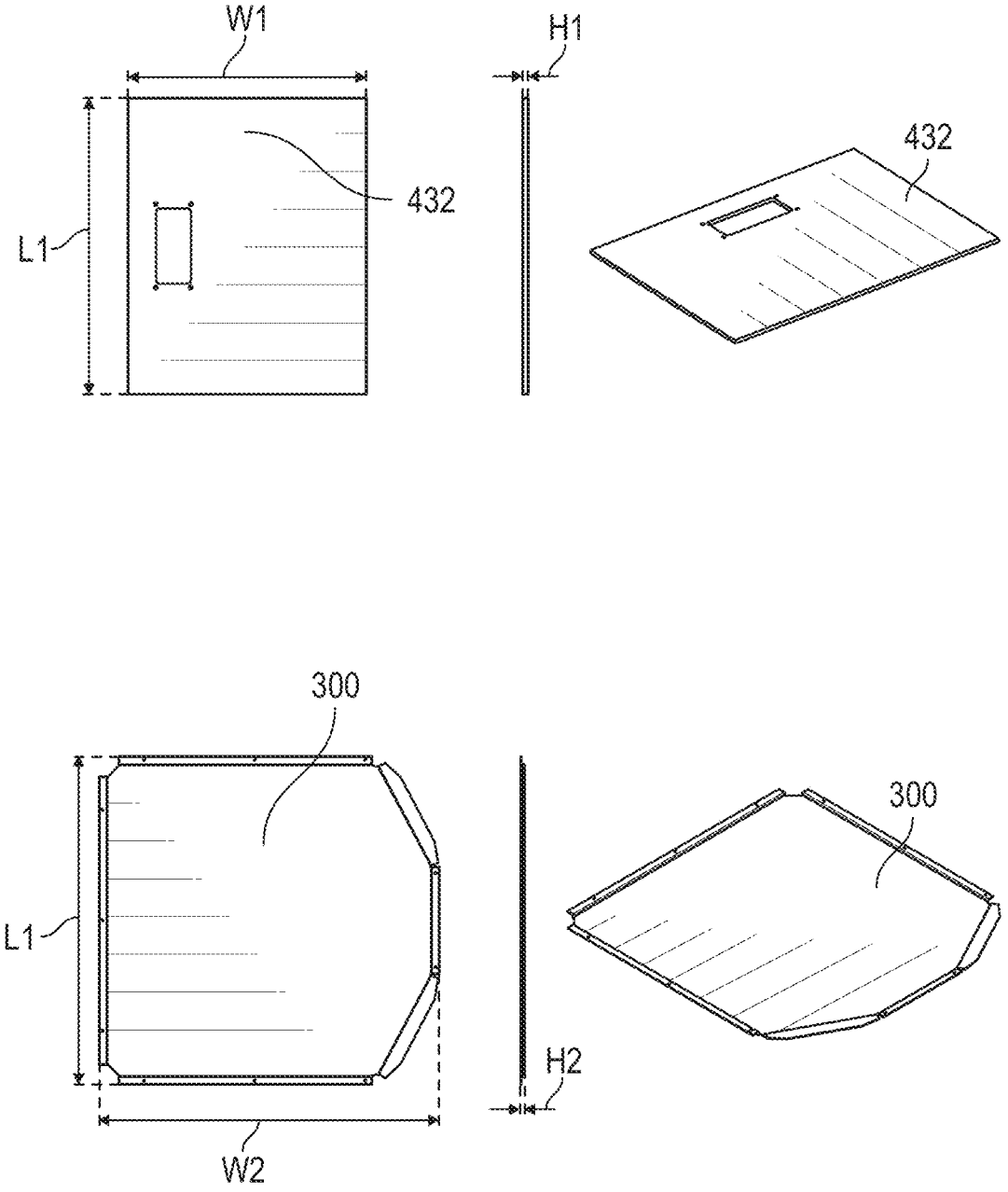
FIG. 12 illustrates top and perspective views of a right base plate and a right base support bottom member.
Figure 13:
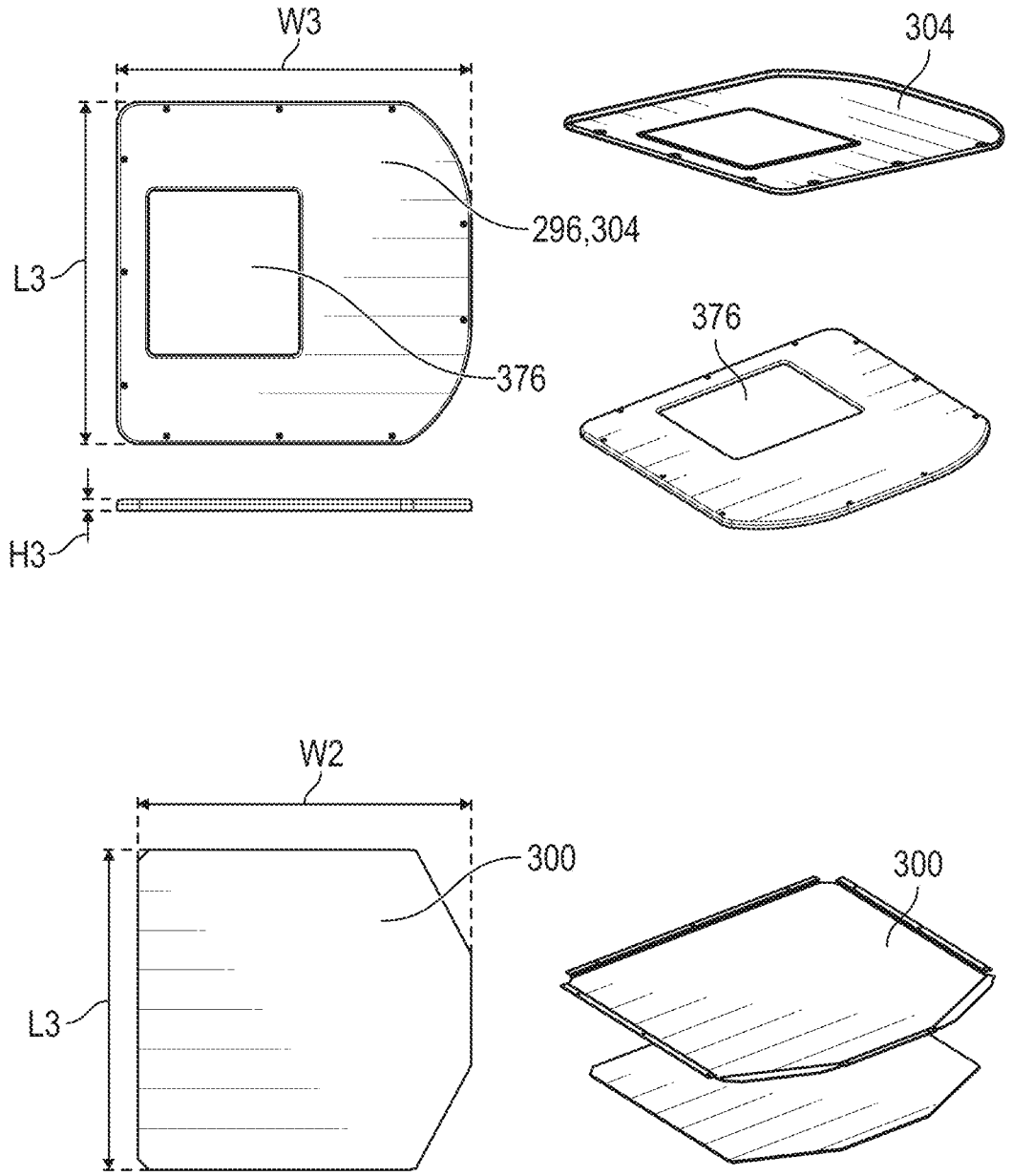
FIG. 13 illustrates top and perspective views of a right base support cover and a right base support bottom member.
Figure 14:
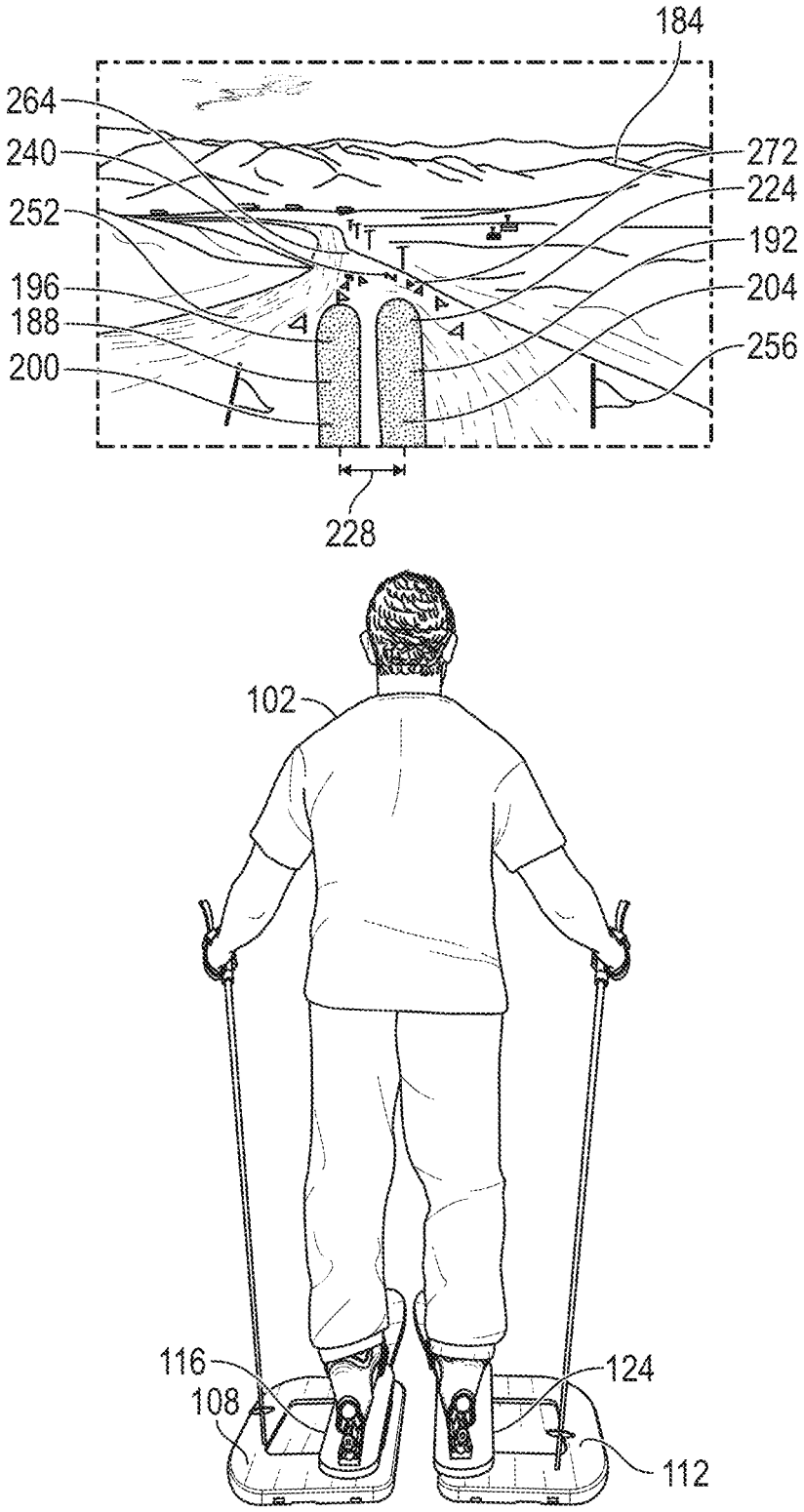
FIG. 14 illustrates a user using an embodiment of a ski simulation and training system and a visual depiction of corresponding skis on a ski run.
Figure 15:
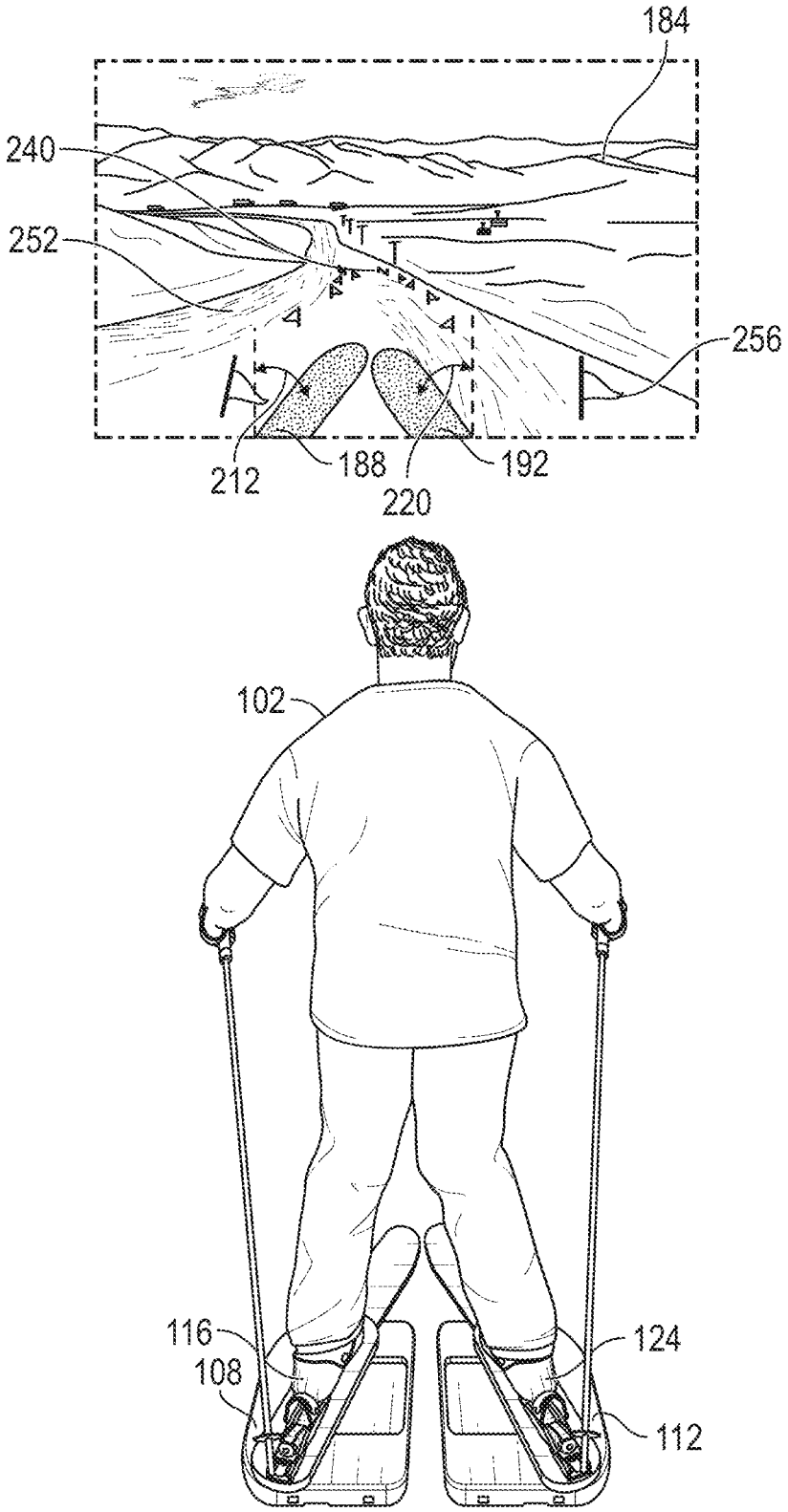
FIG. 15 illustrates a user using an embodiment of a ski simulation and training system and a visual depiction of corresponding skis on a ski run.
Figure 16:
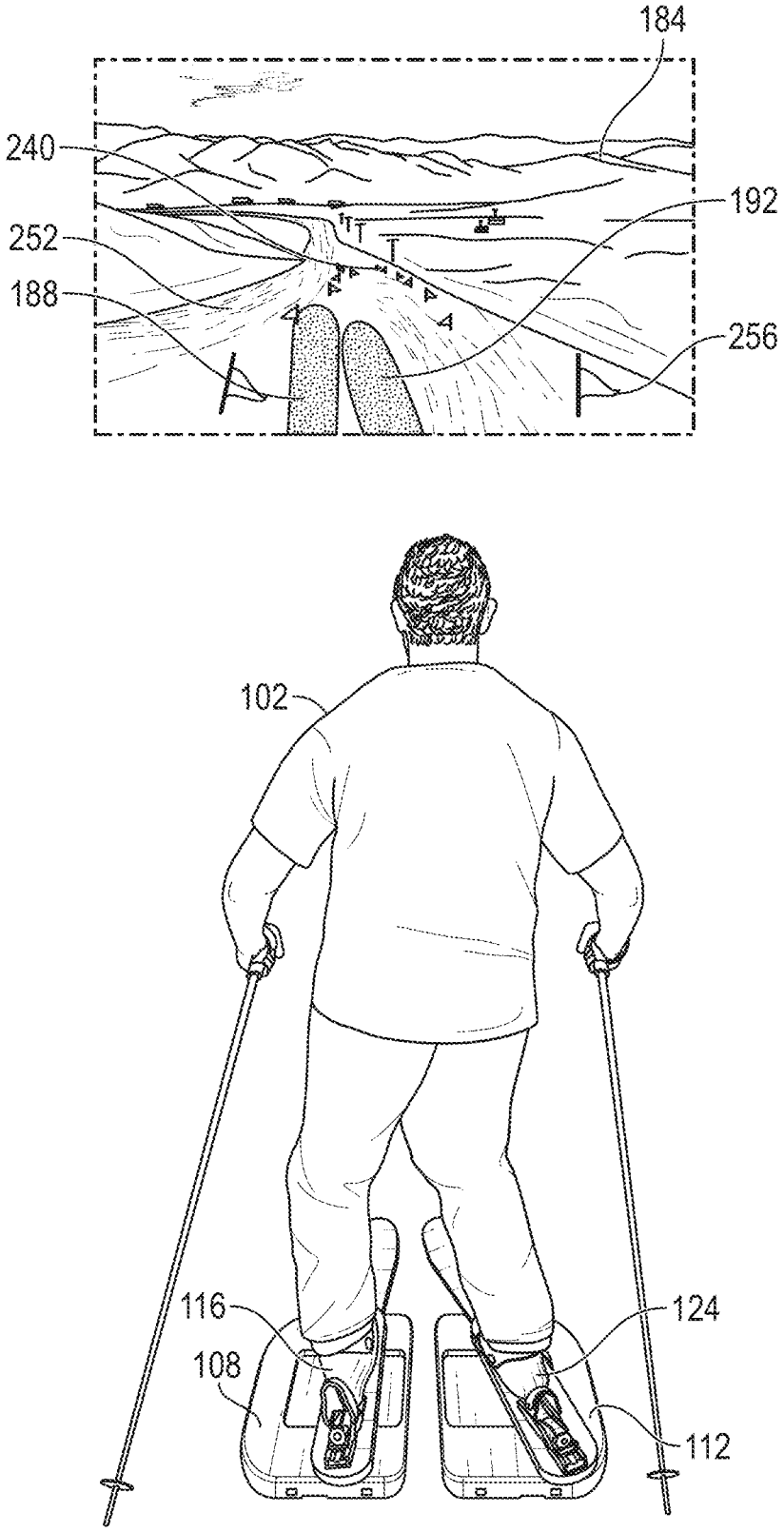
FIG. 16 illustrates a user using an embodiment of a ski simulation and training system and a visual depiction of corresponding skis on a ski run.
Figure 17:
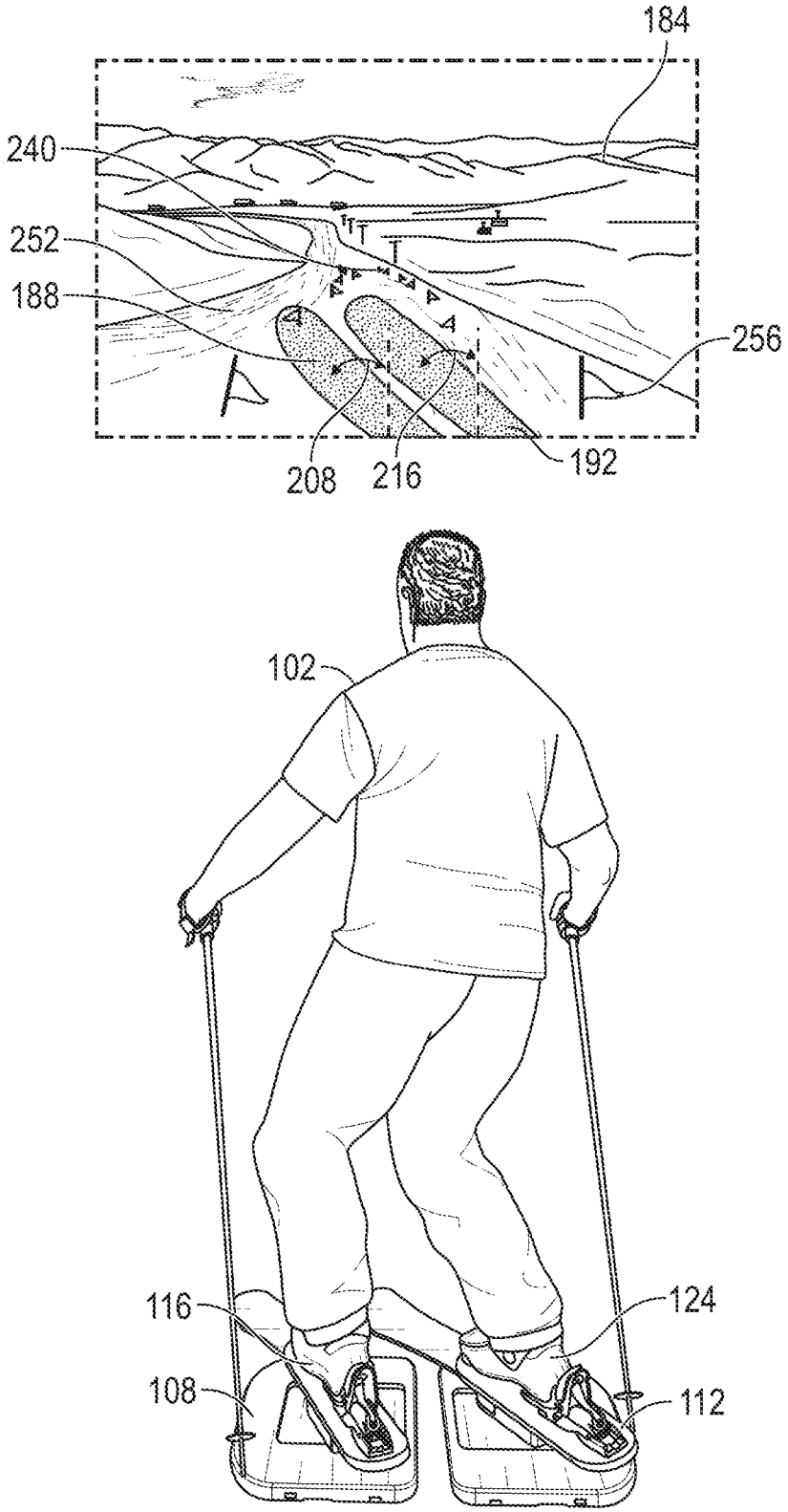
FIG. 17 illustrates a user using an embodiment of a ski simulation and training system and a visual depiction of corresponding skis on a ski run.
Figure 18:
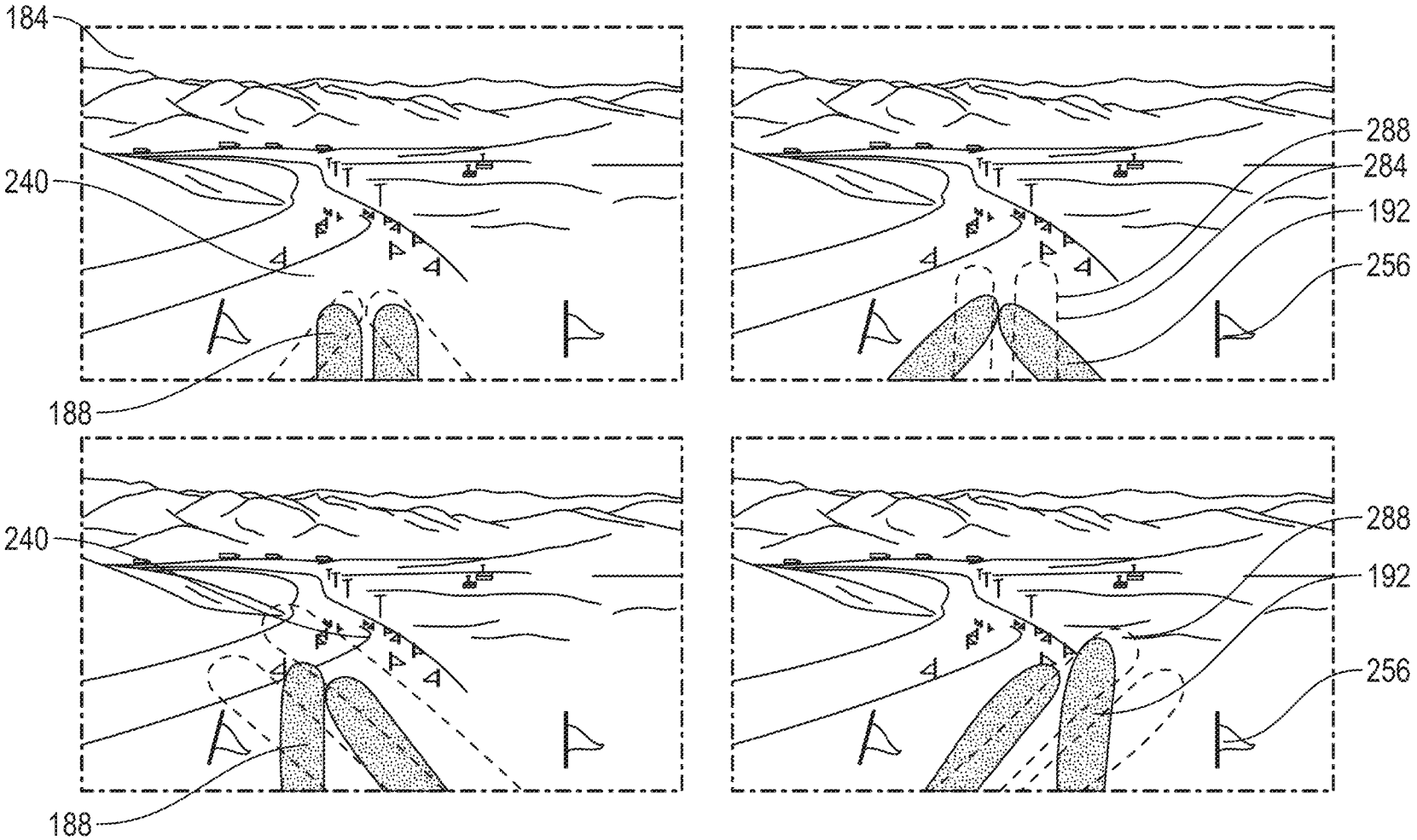
FIG. 18 illustrates a visual depiction of skis on a ski run and a portion of a model pair of skis.
Figure 19:
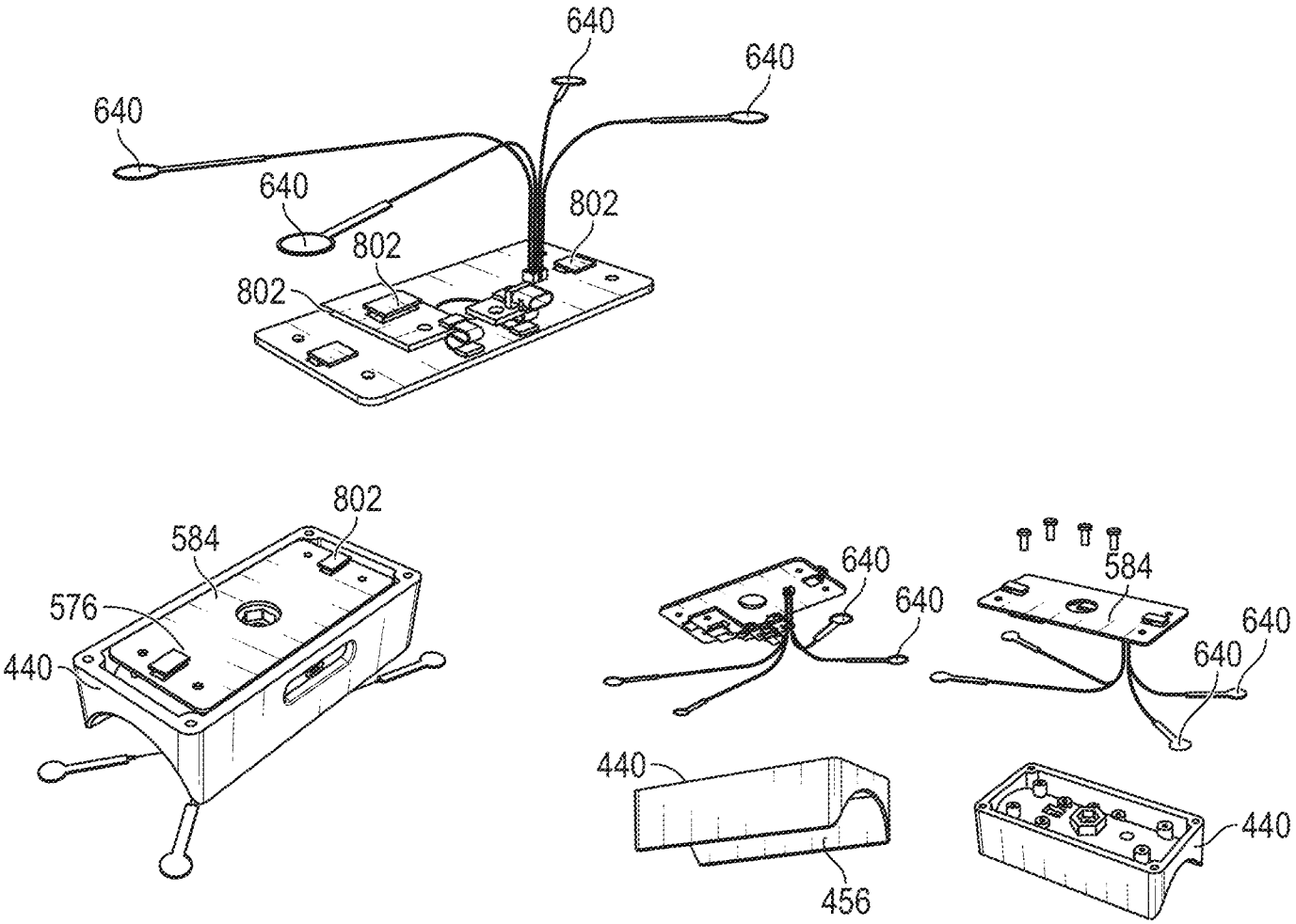
FIG. 19 illustrates a tilt base and corresponding electronics.

Disclosed herein are embodiments of an advanced ski simulation and training system that can be used for any of a wide ranging variety of uses. For example and without limitation, any embodiments of the ski simulation and training system disclosed herein can be used to train users to ski, to ski better, or to learn new skiing related skills. Further, any embodiments of the ski simulation and training system disclosed herein can be used for exercise and training purposes, for balance training, for gaming related applications, for rehabilitating ankle, knee and hip injuries, for re-training the muscles in the legs, hips, buttocks and core may lead to greater stability in the kinetic chain, improving the function of the lower body and core musculature, and for other uses consistent with the embodiments disclosed herein.

Teaching someone to control their skis before their first attempt at sliding down a snow-covered hill may provide a significant advantage. Embodiments of the ski simulation and training system disclosed herein introduce basic skills in the comfort of a controlled environment, creating muscle memory and experiencing skiing virtually, before stepping into one's bindings, makes early skiing proficiency much more attainable in less time.

The sooner the new ski student is riding the chairlift and is no longer in the learning pen, the more enjoyable the experience for both student and instructor. Additionally, a ski school's capacity for increased numbers of students improves. When basic skiing skills are learned quickly and students become more capable of sliding down beginner slopes successfully, the likelihood of individuals returning to ski another day increases.

Stepping out on the slopes with advanced knowledge of how to steer and stop your skis is just what is needed for success. The ski simulation and training system disclosed herein provide the tool that every new skier should experience after they put on their ski boots but before they step outside to put on their skis.

The embodiments of the ski simulation and training system disclosed herein are designed to provide an interactive system that teaches proper ski technique. Whether you are a first-timer or intermediate level skier, there is much to be learned with time on the device. Embodiments of the ski simulation and training system disclosed herein simulate the feel of being on snow while providing feedback to the user through an interactive application. Having an opportunity to practice skills while seeing the results of your movements in real time on a screen in front of you, as provided by at least some embodiments disclosed herein, expedites the learning process. Learning to ski with the ski simulation and training system can provide a fun and fear free experience.

Some embodiments of the ski simulation and training system disclosed herein are intended for use once the student is wearing his/her ski boots, but before mounting the skis. Obtaining a clear understanding of foot/leg movement and body position, as it relates to the skis, is the focus of the learning. When the student consistently moves in a manner that enables their skis to perform basic skills (i.e. going straight, turning right, turning left, stopping), demonstrated visually on a screen before them, they may graduate to the actual activity of skiing on a slope. Any embodiments of the ski simulation and training system disclosed herein can be configured to teach and simulate these basic skills as well as more advanced skills like matching skis (e.g., parallel skiing), moving from edge to base to edge of skis, skidding, sliding and slipping the skis.

Some embodiments can be configured to provide body position tracking determined from the user's movement. For example, some embodiments can be configured to calculate a lower leg/knee movement, which may be used as an indicator of proper skiing mechanics. Any embodiments can also have a sensor that is positioned on the tongue of the user's ski-boot, in addition to, or in place of the sensors under the foot. Such a sensor can be configured to provide a wide range of feedback and information regarding the both position and performance of the user (e.g., knee position, pressure generated underfoot, ski performance and efficient movement patterns)., as well as other valuable information.

Some embodiments of the ski simulation and training system disclosed herein may be programmed with a wide-ranging variety of virtual reality slopes, and may include ones which simulate actual ski slopes, such as those that will be experienced by the users after their training on the ski simulation and training system disclosed herein. The variant conditions the application will offer include, without limitation, grade of slope, obstacles on slope (i.e. boulders, trees, other skiers, cliffs, etc . . . ), snow conditions (groomed, moguls, icy, powder). Some embodiments of the system will also be configured to account for the type of ski that is being used in the above mentioned conditions. Different size and shapes of skis can impact the performance of the skier.

Some embodiments of the ski simulation and training system disclosed herein revolutionize the ski school education experience. Ski instruction has never been so understandable and effective. Embodiments of the ski simulation and training system disclosed herein may allow the student to learn and practice proper ski technique in a controlled environment, which may allow them to develop easily transferrable skills before applying them to real world challenges. The skills learned provide confidence and security for safe performance while sliding down a mountain slope.

Unlike other simulators that currently exist, the embodiments of the ski simulation and training system disclosed herein may allow the user to work on all fundamentals of skiing. Skiing requires rotation of the leg to effectively steer the ski. Skiing requires hip and knee angulation to adjust ski edge angle and maintain balance toward the outside ski. Skiing requires pressure control along the length of the ski. Skiing involves fore and aft movement and lateral movement also. Most ski simulators fall short in allowing rotational movement of the lower leg, boot, and ski. Such simulators focus on movement from edge to edge, which may be okay for advanced ski racers looking to carve turns and stay on their edges. However, most recreational skiers are concerned with shaping turns, not going from edge to edge but going from edge to base to edge of their skis. Working on the base or flat part of the ski is what is lacking from the most popular, expensive ski simulators. There is no rotation happening at all. Embodiments of the ski simulation and training system disclosed herein may provide freedom of movement in the lateral directions, fore and aft directions, and rotation.

Some embodiments of the ski simulation and training system disclosed herein may consist of two main parts, a dynamic platform that may replicate the feeling of being on skis on the snow, and an interactive application. More details about the dynamic will be described first. The platform used in some embodiments of the ski simulation and training system disclosed herein may allow for the simulation of all or nearly all movements one can make on a pair of skis. In some embodiments, the ski simulation and training system may include two pans/trays (also referred to herein as left and right base portions) that may have smooth upper surfaces, two sliders with smooth bottoms (also referred to herein as foot support units), two skis or portions of skis, two-foot plates, two curved or round shaped washers and two tray covers. In any embodiments disclosed herein, each of the two skis or portions of skis may be configured to be tilted by a user (i.e., can be tiltable). Additionally, some embodiments of the ski simulation and training system disclosed herein may include a sensing or tracking system that may detect the orientation and movement of the skis and a processor that may process the data from the tracking system to display the corresponding movements on a screen.

In some embodiments, the platform can include two identical and independently movable units, which may be for each of the user's feet/skis. The two-unit construction may accommodate many sizes of people that may benefit from the device. A taller/larger person may need to spread the units farther apart for a proper ski position. In some embodiments, the two units can be integrally formed so that the left and right sides may be connected and cannot be spaced apart from one another. In some embodiments, the two units may be connectable together so that, if the user desires, the two units can be physically linked together or, alternatively, can be spaced apart at any desired spacing or dimension.

In some embodiments, the trays (also referred to herein as base support assembly or left and right base portions) may be designed to sit on the floor and provide the surface to work from. The upper contact surface of each of the trays may be low friction and allow the user to slide their feet freely, as if on skis in snow. The trays can also be configured to limit the area that the user's feet may travel. The trays may be designed to provide enough space for the feet to move freely and not enough space for the user to lose complete form and end up legs splayed out in a precarious position.

The sliders (also referred to herein as foot support units) may be in direct contact with the tray surface. The foot support units (which can include a left foot support unit and a right foot support unit) may also have a reduced friction lower surface and move easily around the tray, which may simulate or approximate the movement of a ski on the snow. The sliders may include a base for skis, which may include a tilt element. The top part of the slider may have an appendage with a concave surface which may receive the ski. The tilt element may sit in the concave space (also referred to herein as an elongated channel) and may be allowed to tilt or roll side to side when connected by the tilt shaped washer and a bolt and nut. The slider's size and shape may allow it to move freely within the tray without knocking into the walls of the tray until the user loses form with their ski stance. Ideally, the sliders do not bump into the tray walls during use, if the skis are kept in proper form.

The foot support units may allow for angulation of the foot and ski. The round underside of the base for skis may sit in the concave section of the slider appendage. As the user rolls their foot to the inside and outside, turning the ski from flat to on edge (inside and outside), the tilt element may slide in the concave space. The tension of the bolt and nut with the curved or round shaped washer may affect the movement of the foot support units. A tighter bolt and nut may result in a more restricted roll. A heavier user might require more tension than a lightweight user to prevent the tilt from happening as freely.

The foot plates (also referred to herein as cover plates) may sit atop the foot support units. The foot plates may receive the user's foot. They may be the point of connection for the ski boot and the embodiments of the ski simulation and training system disclosed herein. The secure connection may function similar to a ski binding, locking the user's foot in place, which may control the movement of the ski. Additionally, the foot plate may have pressure sensors 485 that may track where the user pushes down in their boots. The sensors may communicate with the application, which may provide additional data to determine how the virtual skier is moving on the slope and display the performance on screen in real-time.

The round or curved shaped washer may work in conjunction with the bolt and nut to affect the movement of the ski tips with roll. The shape of the round or curved shaped washer, as it sits against the ski bases, and its smooth finish, may allow the skis to tilt or roll. The tighter the round or curved shaped washer pushes against the ski bases, the more limited the movement of the skis may be.

The tray covers may keep the working parts free from debris and protect the smooth surfaces from any undo wear and tear. They may also complete the look of the embodiments of the ski simulation and training system disclosed herein. The tray covers may snap into place and may be easily removed for system maintenance.

Ski wax was an unexpected addition to some embodiments of the ski simulation and training system disclosed herein system. During the initial testing of the device, there was more friction than desired between the tray and the sliders. The friction may have inhibited or prevented a smooth gliding motion of the feet. One solution may be to apply ski wax to the bottom of the sliders. Once the ski wax was applied, the sliders (i.e., the foot support units) moved much more smoothly relative to the base portions.

In some embodiments, the position and/or orientation of the skis may be determined using one or more sensors that may be configured to measure a position and an orientation of each of the user's feet, boots, skis, or any combination of these (collectively referred to herein as "feet").

Some embodiments of the system may be configured to provide a visual depiction on a video display that may represent the position and orientation of the user's feet in real-time. Real time may mean that the representation of the position and orientation of the user's feet may be illustrated on the video display with as little lag time as is practical or feasible based on the computing capabilities of modern processors and computers. In some embodiments, the user's feet may be depicted as skis on the video display, being shown in a position, a rotational orientation, and an angulation that closely resembles or matches the position, a rotational orientation, and an angulation of the user's feet. Additionally, in some embodiments, the virtual skis shown on the video display can be shown in motion on a virtual ski slope.

The embodiments of the ski simulation and training system disclosed herein system may have advantages over other ski simulators because the systems disclosed herein may allow the user to move similarly to the way the user may move on the snow. From beginner to experienced skier, skills may be practiced in a safe environment with continuous real-time feedback. Of all currently available simulators, there is only one other machine that allows for truly accurate skiing technique. That machine is the moving carpet type simulator. The problem with the moving carpet simulator is that it takes up a significant amount of space and is very expensive-far more expensive than most users can afford and a significant expense for resorts also. It is not practical in most business spaces.

The more common ski simulators/trainers focus on lateral movement. The action is sliding side to side with limited fore and aft movement and no rotation whatsoever. Rotation, a key component in steering one's skis, is non-existent. These simulators are geared towards ski racing training where the competitors' focus is to place their skis on edge for sharper, faster turns. The goal of shaping turns, controlling speed and making use of the base of the skis, along with the edges, is not a concern.

A) Another use for the ski simulation and training system disclosed herein may be for ski boot fitting. Currently, when purchasing ski boots, the boot fitter may assess a customer's foot profile, select a boot for him or her, tell him or her to put it on and tell the fitter how it feels when they flex their knees forward in the basic ski stance ready position. If the boot feels about right in the flexed position, the customer may be told to go out and ski the boot. "Come back if you have any problems and we can adjust."

In some embodiments, a user may be able to ski in a boot within a retail shop. A boot fitter could observe a customer's skiing and better assess what is happening. Adjustments could be made on the spot before the customer hits the slopes. Boot fitting would be more efficient and customer satisfaction would be much greater. There would be less wasted time running back to the shop for more fittings and corrections. Boot fitters could get the job done right the first time and have more time to sell more boots. The ski boot purchase experience would be made much more enjoyable as the customer would virtually ski their new boots into a comfortable fit.

B) In some embodiments, a ski simulation and training system may allow a user to ski any time to improve their condition, practice their technique and prepare for their next day on the slopes.

C) A ski simulation and training system may allow a user to work on balance and coordination even if they have no desire to ski the slopes. The embodiments disclosed herein may assist a user in practicing their balance and coordination as they ski mountains throughout the world.

D) The embodiments disclosed herein may allow a user to visit a ski resort virtually before taking a vacation. The user may have a head start by familiarizing themselves with the terrain before arriving.

E) The embodiments disclosed herein may allow a user to compete with other gamers on-line. Users may be able to challenge other skiers on slopes they know or slopes they are visiting for the first time. World Ski Challenge™—the first ski video game that requires users to truly know how to ski to play.

Software Application Details:

The application may have a manual mode that may be advanced by an instructor, and/or an automatic mode that may provide an avatar instructor to walk the user through an education process. Some embodiments of the platform may communicate wirelessly with the application to display moves a user makes on a connected screen. Communications may occur via wired connections or wireless communications means. The video interface screen can include a television, a monitor, a tablet, a cell phone, a projector screen, or otherwise. A larger screen may provide a more impressive interaction.

In some embodiments, when the program is running in automatic mode, the application may prompt the user to choose a mode of operation. In some embodiments, there may be an "Education" mode and/or "Ski the World" mode. Both/either modes may be configured to request or prompt the user for some data input for the program to run effectively. For example and without limitation, in some embodiments, height and weight may be input for proper calculations if the user desires maximum authenticity and accuracy when skiing a given slope. For example, a 6'4", 200 lb. person going down a 40 degree slope may move at a different rate of speed than a 5'2", 120 lb. person. Some embodiments of the ski simulation and training system disclosed herein can be configured to request or require that the user input such biometric data, or be configured to accept such biometric data, and adjust the user experience and/or operation of the program accordingly.

In some embodiments, configuring the application to run in education mode may start a game referred to as the Matching Game. In some versions of this mode, a user may be required to match their ski movement with that of the application while skiing down a virtual slope. This can enable the user to see how efficiently the user moves his or her skis. The application can be configured to determine what level skier is using the system through an assigned score. In some embodiments, the system can be configured to provide user feedback or points based on metrics such as turn shape, consistency of movement, etc. As a nonlimiting example, some embodiments of the system can be configured to determine the score based on the efficiency of the user to properly maneuver their skis to meet the challenges of the virtual slope. The score can be based on the data generated by the user's movements and the programs efficiency rating of the movements.

Once the skill level is assessed, the application may begin addressing the deficiencies of the user through ski challenges. For example and without limitation, a new skier may be drilled on all the required basic skills to manage a beginner slope and a more advanced skier may be drilled at sharpening their skills for and "on—i.e., virtually on" the more challenging runs. In some embodiments, drills may be done in a progression with the focus being on sharpening the user's skills to advance them to the next level.

Computing Device

The circuit board optionally includes: one or more infrared LED drivers, one or more peripheral ports, one or more vibration sensors, one voltage regulator, one charge management controller, one or more RGB LED indicators, one or more random access memory cards (RAM), one or more erasable programmable read-only memory cards (EPROM), or other types of non-volatile memory which may store programs and/or data, one or more microprocessors, PIC microcontrollers, and/or signal processors which may access and execute the programs and data, connectors, test interfaces, and/or user accessible controls. Optionally, the circuit board can be expanded by connecting to another extendable circuit board or other module to support additional infrared LEDs including 3, 4, 5, 6 or more infrared LEDs.

Camera Tracking with Aruco Markers

The Aruco marker system may comprise a Raspberry Pi with a camera that may capture images containing one or more markers. These markers may be black and white QR code style images of settable complexity, which can be tracked in space in all degrees of freedom (relative to the camera: X, Y, Z, rotation around X, Y and Z).

Alternatively, there may be other methods of tracking. For example, there may be 4-point tracking on each foot, which may provide all the information needed for tracking 6 degrees of freedom, and which may reduce processing time. Further expansion of this may be to use 4 LEDs, which may simplify detection by a camera.

Tags:

Embodiment of the ski simulation and training system disclosed herein can be configured to provide data from the position tracking sensors wirelessly. For example and without limitation, a wireless precision position tracking device can be used in conjunction with a precision position tracking motion capture system. Optionally, the precision position tracking (PPT) device can be attached to or mounted on an item worn by the user (e.g., headgear). Optionally, the device can be attached to articles of clothing and/or strapped to a user.

In an example optical embodiment, the PPT device may include one or two light emitting components attached to one or more items worn by the user, and the system may track the light source to determine the user's movements in time.

Alternative Sensing Solutions

There may be alternative sensing methods. For example, there may be a mouse sensor that may work on glass. To sense both position and rotation, a second mouse sensor for each foot may be used. The mouse sensors may be recalibrated regularly.

Alternative sensing methods may include, without limitation: VL6180X Time of Flight sensor and Hall effect sensors.

Rasberry Pi for Tag Location and Orientation Processing

A Raspberry Pi may be configured to communicate with a processor (e.g., a computer) with one or more cables, or wirelessly using Bluetooth, Wi-Fi, or other forms of wireless communication.

The computing device can be a standard computer. The computing device may be configured to process information provided by the position sensor subsystem and to control the app. The computing device can be configured to output the program on the video screen.

a Real-Time Image Generator

Other sensors may include a downward facing camera in feet sections, with plate pattern for detecting 3 degrees of freedom, an accelerometers with a gyro or IMU (inertial measurement unit), a laser-optical triangulation, one or more general optical sensors, an ultrasonic distance sensor, which may have focal ultrasonic transducers, an array of hall sensors for detecting electromagnetic patterns in base plate (3, possible 5 degrees of movement), or any combination of the foregoing.

With reference to the figures, in some embodiments, the ski simulation and training device 100 may include a base support assembly 104, which may include a left base portion 108 and a right base portion 112, a left foot support unit 116, which may be adapted to receive and support a user's left foot 120, a right foot support unit 124, which may be adapted to receive and support a user's right foot 128, a position measuring unit 132, a computing device 136, and a video display 140.

In some embodiments, the left foot support unit 116 may be adapted to move independently of the right foot support unit 124. The left base portion 108 and the right base portion 112 may be adapted to be independently movable. For example, the left base portion 108 and the right base portion 112 may be spaced farther apart from each other for a larger person. In another example, the left base portion 108 and the right base portion 112 may be placed closer together for a shorter person. In some embodiments, left base portion 108 and right base portion 112 may be connectable together so that the left base portion 108 and the right base portion 112 may be physically linked together. In an alternative example, the left base portion 108 and the right base portion 112 may be spaced apart at a desired spacing or dimension.

The left foot support unit 116 may be translatable relative to the left base portion 108 in at least two directions about an upper support surface 144 of the left base portion 108 so that a user 102 may be capable of moving his or her left foot 120 in at least two directions about the upper support surface 144 of left base portion 108.

The left foot support unit 116 may be rotatable relative to the left base portion 108 so that the user 102 may be able to rotate his or her left foot 120 in a clockwise or counter-clockwise direction relative to the left base portion 108.

The left foot support unit 116 may be tiltable so that the user 102 may be capable of tilting his or her left foot 120 in a leftward direction or in a rightward direction relative to a plane 148 that may be perpendicular to the upper support surface 144 of the left base portion 108.

In some embodiments, the right foot support unit 124 may be translatable relative to the right base portion 112 in at least two directions about an upper support surface 152 of the right base portion 112 so that user 102 may be capable of moving his or her right foot 128 in at least two directions about the upper support surface 152 of right base portion 112.

The right foot support unit 124 may be rotatable relative to the right base portion 112 so that the user 102 may be capable of rotating his or her right foot 128 in a clockwise or counter-clockwise direction relative to the right base portion 112.

The right foot support unit 124 may be tiltable so that the user 102 may be capable of tilting his or her right foot 128 in a leftward direction or in a rightward direction relative to a plane 160 that may be perpendicular to the upper support surface 152 of the right base portion 112.

For example, the left base portion 108 and the right base portion 112 may sit on a floor or ground surface 384. The upper surfaces 144, 152 of the left base portion 108 and the right base portion 112 may have low friction which may allow the left foot support unit 116 and right foot support unit 124 to slide across the upper surfaces 144, 152, as if on snow. In some embodiments, the left foot support unit 116 and right foot support unit 124 may have reduced friction to help slide across the upper surfaces 144, 152 of the left base portion 108 and right base portion 112.

The position measuring unit 132 may be adapted to, in an operable state, collect data that may be used by the computing device 136 to determine: a distance 164 that the user's left foot may be spaced apart in a lateral direction from the user's right foot, a rotational orientation 168 of the user's left foot (e.g., a measure of how much the user's left foot 120 has rotated or twisted relative to a reference orientation, such as a perfectly straight orientation perfectly aligned with the user's direction of travel), a tilt angle 172 of the user's left foot 120 relative to the plane 148 that may be perpendicular to the upper support surface 144 of the left base portion 108 (e.g., a measure of how much the user's left foot 120 or left lower leg 232 is leaning in a lateral direction relative to a perfectly upright position, i.e., how much the user's left foot 120 or the left lower leg 232 has rotated about a second axis that is parallel to the upper support surface of the left foot support unit 106 and that is in the same direction as a length of the user's left foot 120), a rotational orientation 176 of the user's right foot 128 (e.g., a measure of how much the user's right foot has rotated or twisted relative to a reference orientation, such as a perfectly straight orientation perfectly aligned with the user's direction of travel), and a tilt angle 180 of the user's right foot 128 relative to the plane 160 that may be perpendicular to the upper support surface 152 of the right base portion 112 (e.g., a measure of how much the user's right foot 128 or right lower leg 236 is leaning in a lateral direction relative to a perfectly upright position, i.e., how much the user's right foot 128 or right lower leg 236 has rotated about a second axis that is parallel to the upper support surface of the right foot support unit 124 and that is in the same direction as a length of the user's right foot 128).

The computing device 136 may be adapted to determine the following using the data from the position measuring unit 132: the distance 164 that the user's left foot 120 is spaced apart in a lateral direction from the user's right foot 128, the rotational orientation 168 and the tilt angle 172 of the user's left foot, and the rotational orientation 176 and the tilt angle 180 of the user's right foot 128.

Visual Display

The computing device 136 may be adapted to cause the video display 140 to display a visual depiction 184 of at least a portion 188 of a left ski 200 and a portion 192 of a right ski 204.

The computing device 136 may be adapted to illustrate a visual depiction 184 of the rotational orientation 168, 176 and the tilt angle 172, 180 of the user's left foot 120 and the user's right foot 128 on the video display 140.

The computing device 136 may be adapted to illustrate a visual depiction 184 on the video display 140 of a first virtual object 196, such as a ski 200, 204 or a portion 188, 192 of a ski 200, 204, in a rotational orientation 208, 216 and a tilt angle 212, 220 that may correspond to the rotational orientation 168, 176 and the tilt angle 172, 180 of the user's left foot 120 or the user's right foot 128. The computing device 136 may be adapted to illustrate a visual depiction 184 on the video display 140 of a second virtual object 224, such as a ski 200, 204 or a portion 188, 192 of a ski 200, 204, in a rotational orientation 208, 216 and a tilt angle 212, 220 that may correspond to the rotational orientation 168, 176 and the tilt angle 172, 180 of the other of the user's left foot 120 or the user's right foot 128.

The computing device 136 may be adapted to cause the video display 140 to display a visual depiction 184 that may include a portion 188 of a left ski 200 that may move in response to and be consistent with a movement of the user's left foot 120 and a portion 188 of a right ski 204 that may move in response to and be consistent with a movement of the user's right foot 128.

The computing device 136 may be adapted to cause the video display 140 to display a visual depiction 184 that may include a portion 188 of a left ski 200 in a rotational orientation 208 and a tilt angle 212 that may correspond to the rotational orientation 168 and the tilt angle 172 of the user's left foot 120. The visual depiction 184 may include a portion 192 of a right ski 204 in a rotational orientation 216 and a tilt angle 220 that may correspond to the rotational orientation 176 and the tilt angle 180 of the user's right foot 128.

The video display 140 may depict the portion 188 of a left ski 200 in a rotational orientation 208 that may simulate the rotational orientation 168 of the user's left foot 120. The video display 140 may depict a portion 192 of the right ski 204 in a rotational orientation that may simulate the rotational orientation 176 of the user's right foot 128. The video display 140 may depict the portion 188 of the left ski at a distance 228 from the portion 192 of the right ski 204 that may correspond to the distance 164 that the user's left foot 120 is spaced apart in the lateral direction from the user's right foot 128.

The video display 140 may depict the portion 188 of the left ski at a tilt angle 212 that may simulate the tilt angle 172 of the user's left foot 120 or left lower leg 232. The video display 140 may depict the portion 192 of the right ski at a tilt angle 220 that may simulate the tilt angle 180 of the user's right foot 128 or right lower leg 236.

The computing device 136 may be adapted to cause the video display 140 to display a visual depiction 184 of a ski run 240 with at least a portion 188, 192 of a left ski 200 and a right ski 204 skiing down the ski run 240. In some embodiments, the portion 188 of the left ski may 200 simulate a movement of an actual ski 244 that may perform in a way that may be consistent with a movement and an orientation 168 of the user's left foot 120. The portion 192 of the right ski 204 may simulate a movement of an actual ski 248 that may perform in a way that may be consistent with a movement and an orientation 176 of the user's right foot 128.

The computing device 136 may be adapted to cause the video display 140 to display a visual depiction 184 of a ski run 240 having snow 252 and ski gates 256.

The computing device 136 may be adapted to illustrate a visual depiction 184 on the video display 140 of the left ski 200 or a portion 188 of a left ski 200 and a right ski 204 or a portion 192 of the right ski 204 and a plurality of gates 256 or objects 260 for the user 102 to simulate skiing around. In some embodiments, the gates 256 or objects 260 may be color coded so that gates 256 or objects 260 on a left side 264 of the ski run 240 may have a first color 268 that may match the left ski 200 and so that gates 256 or objects 260 on a right side 272 of the ski run 240 may have a second color 276 that may match the right ski 204. In some embodiments, the first color 268 may be different than the second color 276.

The computing device 136 may be adapted to cause the video display 140 to display a visual depiction 184 of a target 280 for the user 102 to follow.

The computing device 136 may be adapted to cause the video display 140 to display a visual depiction 184 of a model pair of skis 284 or a model portion of a pair of skis 288 for the user 102 to try to match a movement of.

Base Portion:

In some embodiments, the left base portion 108 may be separate from and independently movable relative to the right base portion 112 so that the left base portion 108 can be moved relative to the right base portion 112 and/or spaced apart from the right base portion 112. This can be done, for example and without limitation, to accommodate different sized users.

The left base portion 108 may be adapted to limit a movement of the left foot support unit 116 in the fore direction and the aft direction and in a second lateral direction so that a user 102 only be able to move his or her left foot 120 in the fore direction and the aft direction and in the second lateral direction within a limited range. In some embodiments, the right base portion 112 may be adapted to limit a movement of the right foot support unit 124 in the fore direction and the aft direction and in a second lateral direction so that a user 102 may only be able to move his or her right foot 128 in the first fore and aft direction and in the second lateral direction to a limited extent.

The left base portion 108 may be adapted to limit a movement of the left foot support unit 116 in a fore and aft direction to within a four inch or approximately four inch range, or a six inch or approximately six inch range, or an eight inch or approximately eight inch range, or a ten inch or approximately ten inch range, or a twelve inch or approximately twelve inch range, or from a four inch or approximately four inch range to a ten inch or approximately ten inch range, or from a six inch or approximately six inch range to a ten inch or approximately ten inch range, or of any value, approximately value, or range of values of the foregoing ranges.

The right base portion 112 may be adapted to limit a movement of the right foot support unit 124 in a fore and aft direction to within a four inch or approximately four inch range, or a six inch or approximately six inch range, or an eight inch or approximately eight inch range, or a ten inch or approximately ten inch range, or a twelve inch or approximately twelve inch range, or from a four inch or approximately four inch range to a ten inch or approximately ten inch range, or from a six inch or approximately six inch range to a ten inch or approximately ten inch range, or of any value, approximately value, or range of values of the foregoing ranges.

In some embodiments, the left base portion 108 may be adapted to limit a movement of the left foot support unit 116 in a left and right lateral direction to within a four inch or approximately four inch range, or a six inch or approximately six inch range, or an eight inch or approximately eight inch range, or a ten inch or approximately ten inch range, or a twelve inch or approximately twelve inch range, or from a four inch or approximately four inch range to a ten inch or approximately ten inch range, or from a six inch or approximately six inch range to a ten inch or approximately ten inch range, or of any value, approximately value, or range of values of the foregoing ranges.

The right base portion 112 may be adapted to limit a movement of the right foot support unit 124 in a left and right lateral direction to within a four inch or approximately four inch range, or a six inch or approximately six inch range, or an eight inch or approximately eight inch range, or a ten inch or approximately ten inch range, or a twelve inch or approximately twelve inch range, or from a four inch or approximately four inch range to a ten inch or approximately ten inch range, or from a six inch or approximately six inch range to a ten inch or approximately ten inch range, or of any value, approximately value, or range of values of the foregoing ranges.

The left base portion 108 may include a left base support bottom member 292 and a left base support cover 296 that may be coupled to the left base support bottom member 292. The right base portion 112 may include a right base support bottom member 300 and a right base support cover 304 that may be coupled to the right base support bottom member 300.

The left base support bottom member 292 may have a perimeter wall 308 that may be around a perimeter 312 of the left base support bottom member 292 that may be adapted to limit a range of movement of the left foot support unit 116 in the lateral direction and in the longitudinal direction. The right base support bottom member 300 may have a perimeter wall 316 that may be around a perimeter 320 of the right base support bottom member 300 that may be adapted to limit a range of movement of the right foot support unit 124 in the lateral direction and in the longitudinal direction.

The left base support bottom member 292 may have a planar surface 324 that may include the upper support surface 144 of the left base portion 108, and the right base support bottom member 300 may have a planar surface 328 that may include the upper support surface 152 of the right base portion 112.

The left base support bottom member 292 and the right base support bottom member 300 may each include a flange 332, 336 extending away from a top of the perimeter wall 308, 316 that may extend away from at least a portion of the perimeter wall 308, 316.

The left base portion 108 may include two linear or straight side edges 340 that may be parallel with one another and a straight back edge 344 that may be perpendicular to the two linear side edges 340. In some embodiments, the right base portion 112 may include two linear or straight side edges 348 that may be parallel with one another and a straight back edge 352 that may be perpendicular to the two linear side edges 348.

The left base portion 108 and the right base portion 112 may each include a front edge 356, 358. The front edge 356, 358 may include a curve shaped surface 360 or have a segmented front edge that may have a middle segment 364, 366. The middle segment 364, 366 may be parallel with the back edge 344 and two angled side segments 340 that may be at an acute angle relative to the middle segment 364, 366 (e.g., at an angle that is 30 degrees or approximately 30 degrees relative to the middle segment 364, 366, or from 20 degrees or approximately 20 degrees to 40 degrees or approximately 40 degrees relative to the middle segment 364, 366).

The left base support cover 296 may include an opening 368 in a top surface 372 thereof through which a portion of the left foot support unit 116 may extend. The right base support cover 304 may have an opening 376 in a top surface 380 thereof through which a portion of the right foot support unit 124 may extend.

In some embodiments, the opening 368 in the left base support cover 296 member may have an area that may be at least 25% of a surface area of a top surface 372 of the left base support cover 296. In some embodiments, the opening 376 in the right base support cover 304 member may have an area that may be at least 25% of a surface area of a top surface 380 of the right base support cover 304.

The opening 368 in the left base support cover 296 member may have an area that may be from 25% or approximately 25% to 50% or approximately 50% of a surface area of a top surface 372 of the left base support cover 296. The opening 376 in the right base support cover 304 member may have an area that may be from 25% or approximately 25% to 50% or approximately 50% of the surface area of a top surface 380 of the right base support cover 304.

The left base portion 108 may be a mirror image of the right base portion 112. In some embodiments, left base portion 108 may be two feet or approximately two feet wide by two feet or approximately two feet long and the right base portion 112 may be two feet or approximately two feet wide by two feet or approximately two feet long. The left base portion 108 and the right base portion 112 may be made from plastic. In other embodiments, the left base portion 108 and the right base portion 112 may be made from metal or another material or combination of materials. The left base portion 108 and the right base portion 112 may be adapted to rest directly or indirectly on a ground surface 384. The left base portion 108 and the right base portion 112 may each include a grip pad 388, 392 beneath a bottom surface 396, 400 of the base support bottom member 292, 300 of each of the left base portion 108 and the right base portion 112.

In some embodiments, the left foot support unit 116 and the right foot support unit 124 may be capable of moving relative to left base portion 108 and the right base portion 112, respectively. In some embodiments, the base support assembly 104 may include a single base member 404, which may have a left side 408 and a right side 412. The left side and right side may be connected or integrally formed. In some embodiments, the base support assembly 104 may include a left base portion 108 and/or a right base portion 112 that may not be connected but which may be separately movable or positionable on the floor surface. For example and without limitation, if a user prefers more space between their feet (or skis) when their feet are closest together, the left base portion 108 may be spaced apart from the right base portion 112 and, if a user prefers less space between their feet (or skis) when their feet are closest together, the left base portion 108 may be positioned adjacent to or against the right base portion 112, or may be positioned a small distance away from the right base portion 112.

Foot Supports:

In some embodiments, the at least two directions that the left foot support unit 116 may be adapted to move about the upper support surface 144 of the left base portion 108 may include a longitudinal direction and a lateral direction. In some embodiments, the at least two directions that the right foot support unit 124 may be adapted to move about the upper support surface 152 of the right base portion 112 may include the longitudinal direction and the lateral direction.

The longitudinal direction may be in a fore direction (e.g., toward a front end of the left base portion 108 or the right base portion 112) and an aft direction (e.g., toward a rearward end of the left base portion 108 or the right base portion 112).

The lateral direction may be in a left lateral direction (e.g., toward a left side of the left base portion 108 or the right base portion 112) and a right lateral direction (e.g., toward a right side of the left base portion 108 or the right base portion 112).

The left foot support unit 116 may be adapted to rotate relative to the upper support surface 144 of the left base portion 108. The rotation relative to the upper support surface 144 of the left base portion 108 may be about an axis that may be perpendicular to the upper support surface 144 of the left base portion 108. The right foot support unit 124 may be adapted to rotate relative to the upper support surface 152 of the right base portion 112. The rotation relative to the upper support surface 152 of the right base portion 112 may be about an axis that may be perpendicular to the upper support surface 152 of the right base portion 112.

The left foot support unit 116 may be adapted to receive and/or couple with a user's left foot 120, a user's left shoe, or a user's left ski boot 416 and the right foot support unit 124 may be adapted to receive or couple with a user's right foot 128, a user's right shoe, or a user's right ski boot 420.

Components of the Support Units

In some embodiments, the left foot support unit 116 may be a mirror image of the right foot support unit 124. The left foot support unit 116 may include: a base plate 424 configured to be supported against the upper support surface 144 of the left base portion 108, and a tilt element 428, 436 coupled to the base plate 424. The right foot support unit 124 may include: a base plate 432 configured to be supported against the upper support surface 152 of the right base portion 112; and a tilt element 428, 436 coupled to the base plate 432.

The tilt element 428, 436 of the left foot support unit 116 and the right foot support unit 124 may include a tilt base 440, 444 coupled to the base plate 424, 432 of the left foot support unit 116 and the right foot support unit 124. The tilt element 428, 436 may include a tilting member 448, 452 coupled to the tilt base 440, 444. The tilt base 440, 444 may include an elongated channel 456, 460 along at least a portion of a length of an upper portion 464, 468 of the tilt base 440, 444. The elongated channel 456, 460 may face generally upwardly when the tilt base 440, 444 is in an operable position. The elongated channel 456, 460 may include a semi-circular curved surface 472, 476 along a length of the elongated channel 456, 460. The tilting member 448, 452 may have an elongated projection 480, 484 along at least a portion of a length of a lower portion 488, 492 of the tilting member 448, 452. The elongated projection 480, 484 may face generally downward when the tilting member 448, 452 is in an operable position. The elongated projection 480, 484 may be configured to be received by the elongated channel 456, 460 of the tilt base 440, 444 in an operable position. The elongated projection 480, 484 may have a shape that may be complementary to a shape of the elongated channel 456, 460. The elongated projection 480, 484 of the tilting member 448, 452 may be configured to slidably rotate within the elongated channel 456, 460 of the tilt base 440, 444 which may permit the tilting member 448, 452 to tilt relative to the tilt base 440, 444.

The tilt element 428, 436 of the left foot support unit 116 and the right foot support unit 124 may be adapted so that the tilting member 448, 452 can only tilt within a predefined angular range 496, 500 relative to the tilt base 440, 444. For example, and without limitation, from a neutral position 504, 508 in which the tilting member 448, 452 may be centered relative to the tilt base 440, 444, the tilting member 448, 452 may rotate clockwise or counterclockwise to an angle of 30 degrees or approximately 30 degrees relative to the tilt base 440, 444, or to an angle of 45 degrees or approximately 45 degrees relative to the tilt base 440, 444, or to an angle of 20 degrees or approximately 20 degrees relative to the tilt base 440, 444, or to an angle of 10 degrees or approximately 10 degrees relative to the tilt base 440, 444, or to an angle that is from 5 degrees or approximately 5 degrees or less to 45 degrees or approximately 45 degrees or more relative to the tilt base 440, 444, or to an angle that is from 5 degrees or approximately 5 degrees or less to 30 degrees or approximately 30 degrees or more relative to the tilt base 440, 444, or to an angle that is from 5 degrees or approximately 5 degrees or less to 20 degrees or approximately 20 degrees or more relative to the tilt base 440, 444, or of any value, approximate value, or range of values within any of the foregoing ranges.

The tilt element 428, 436 may include a fastener 512, 516 (e.g., a bolt or a screw) and a bushing 520, 524 that may couple the tilting member 448, 452 to the tilt base 440, 444. The bushing 520, 524 may have a female threaded opening 528, 532 therein that may be configured to receive the fastener 512, 516. In some embodiments, the tilt base 440, 444 and the tilting member 448, 452 may be between a head 536, 540 of the fastener and the bushing 520, 524 so that, as the fastener 512, 516 is tightened relative to the bushing 520, 524, the tilting member 448, 452 may be compressed against the tilt base 440, 444. By tightening the fastener 512, 516, a resistance to tilting movement can be adjusted.

The fastener may extend through an opening 544, 548 in the tilt base 440, 444 and the tilting member 448, 452, and may be threadedly received by the opening 528, 532 in the bushing 520, 524. In some embodiments, increasing a level of torque between the fastener 512, 516 and the bushing 520, 524 may increase a resistance to a movement between the tilting member 448, 452 and the tilt base 440, 444.

The left foot support unit 116 may include a cover plate 552 that may be coupled to the tilt element 428, 436 of the left foot support unit 116. The right foot support unit 124 may include a cover plate 556 that may be coupled to the tilt element 428, 436 of the right foot support unit 124. The cover plate 552, 556 may be removable from the tilt element 428, 436 of either of the left foot support unit 116 and the right foot support unit 124 without using any tools (e.g., by hand) to permit the interchangeability of the cover plate 552, 556. The cover plate 552, 556 may be removable but selectively securable (i.e., lockable) to the tilt element 428, 436 of either of the left foot support unit 116 or the right foot support unit 124 with or without a use of any tools (e.g., by hand) to permit the selectable interchangeability of the cover plate 552, 556.

The tilt element 428, 436 may include one or two (or more) bosses 560, 564 extending in an upward direction when the device is in an operable position and which are received by one or two (or more) recesses 568, 572 in the cover plate 552, 556. The tilt element 428, 436 may include a tilt-shaped washer 756, 760. The tilt-shaped washer 756, 760 may secure to the elongated channel 456, 460 and/or the elongated projection 480, 484. The tilt-shaped washer 756, 760 may be configured to receive the fastener 512, 516.

The left foot support unit 116 may include a pressure plate 576 that may be coupled to the tilt element 428 of the left foot support unit 116. The pressure plate 576 of the left foot support unit 116 may be adapted to couple directly to a bottom 580 of the cover plate 552 of the left foot support unit 116. The right foot support unit 124 may include a pressure plate 584 that may be coupled to the tilt element 436 of the right foot support unit 124. The pressure plate 584 of the right support unit may be adapted to couple directly to a bottom 588 of the cover plate of the right foot support unit 124.

The cover plate 552, 556 may include a shoe adapter 592, 596, which may include a rubber gripping surface 600, 604. The cover plate 552, 556 on each of the left foot support unit 116 and the right foot support unit 124 may include a ski binding 608, 612 configured to couple to a ski boot 416, 420. The left foot support unit 116 may include a mock ski 616 or a portion of a mock ski 616, or a simulated ski 624 or a portion of a simulated ski 624. The right foot support unit 124 may include a mock ski 620 or a portion of a mock ski 620, or a simulated ski 628 or a portion of a simulated ski 628.

The left foot support unit 116 may include a ski binding 608 on the mock ski 616 or the portion of the mock ski 616 or the simulated ski 624 or the portion of the simulated ski 624. The right foot support unit 124 may include a ski binding 612 on the mock ski 620 or the portion of the mock ski 620 or the simulated ski 628 or the portion of the simulated ski 628. The left foot support unit 116 and the right foot support unit 124 may each include a ski binding 608, 612 adapted to receive a ski boot 416, 420. The left foot support unit 116 may be independently movable relative to the right foot support unit 124.

The left foot support unit 116 may include a sliding base portion 632 that may be adapted to translate about the upper support surface 144 of the left base portion 108 and a tilting member 448 that may be coupled to the sliding base portion 632. The tilting member 448 may be adapted to tilt about an axis that may be parallel to the upper support surface of the left base portion 108.

The right foot support unit 124 may include a sliding base portion 636 that may be adapted to translate about the upper support surface 152 of the right base portion 112 and a tilting member 452 coupled to the sliding base portion 636, the tilting member 452 being adapted to tilt about an axis that may be parallel to the upper support surface of the right base portion 112. The left foot support unit 116 and the right foot support unit 124 may each include one or more pressure sensors 640, 644 that may be configured to gather data 648 that may be related to a pressure or a force that may be applied to the left foot support unit 116 and the right foot support unit 124.

The data 648 that may be related to the pressure or the force that may be applied to the left foot support unit 116 and the right foot support unit 124 may be communicated to the computing device 136, and may be used to simulate how the user's skis 616, 620 may behave on a virtual snow surface 652. In some embodiments, components of the left foot support unit 116 and the right foot support unit 124 other than the fastener may each be made from plastic, metal, fiber reinforced plastic, or any combination of the foregoing.

Base plate 424, 432 may have a length L1, width W1, and height H1. Base support bottom member 292, 300 may have a length L2, width W2, and height H2. Support cover 296, 304 may have a length L3, width W3, and height H3. In any embodiments of the base plate disclosed herein, the length L1 can be 20 inches or approximately 20 inches, or from 15 inches or less to 25 inches or more, the width W1 can be 16 inches or approximately 16 inches, or from 15 inches or less to 25 inches or more, and the height or thickness H1 can be 0.25 inch or approximately 0.25 inch, or from 0.20 inch or less to 0.5 inch or more. In any embodiments of the base support bottom member disclosed herein, the length L2 can be 26 inches or approximately 26 inches, or from 20 inches or less to 30 inches or more, the width W2 can be 28 inches or approximately 28 inches, or from 20 inches or less to 35 inches or more, and the height or thickness H2 can be 0.33 inch or approximately 0.33 inch, or from 0.20 inch or less to 0.5 inch or more. In any embodiments of the base support cover disclosed herein, the length L3 can be 27 inches or approximately 27 inches, or from 20 inches or less to 30 inches or more, the width W3 can be 28 inches or approximately 28 inches, or from 20 inches or less to 35 inches or more, and the height or thickness H3 can be 0.6 inch or approximately 0.6 inch, or from 0.20 inch or less to 1 inch or more.

Position Measuring Unit

In some embodiments, the position measuring unit 132 may include a first marker tag 656 positioned on the left foot support unit 116, a second marker tag 660 positioned on the right foot support unit 124, and a camera 664. In some embodiments, the computing device 136 may be adapted to measure the position 668, the rotational orientation 168, and the tilt angle 172 of the user's left foot 120 based on a position 672, a rotational orientation 676, and a tilt angle 680 of the first marker tag 656. The computing device 136 may be adapted to measure the position 684, the rotational orientation 176, and the tilt angle 180 of the user's right foot 128 based on a position 688, a rotational orientation 692, and a tilt angle 696 of the second marker tag.

The position measuring unit 132 may be further adapted to measure a position 668 of the user's left foot 120 and a position 684 of the user's right foot 128. The first marker tag 656 may be positioned on a rearward facing surface 700 of the left foot support unit 116 and the second marker tag 660 may be positioned on a rearward facing surface 704 of the right foot support unit 124. The first marker tag 656 and the second marker 660 tag may be fiducial markers 708. In some embodiments, the first marker tag 656 and the second marker tag 660 may be ARUCO markers 712.

The position measuring unit 132 may include an optical sensor 716. In some embodiments, the position measuring unit 132 may include a lidar sensor 720. In some embodiments, the position measuring unit 132 may include a time of flight sensor 724. In some embodiments, the position measuring unit 132 may include a laser sensor 728. In some embodiments, the position measuring unit 132 may include a processor 732 with a raspberry pi computing device 736. In some embodiments, the computing device 136 may include a raspberry pi computing device 736 and memory storage device 740.

Miscellaneous

In some embodiments, the ski simulation and training device 100 may include a pair of ski poles 744. In some embodiments, the ski simulation and training device 100 may include wax 748 (such as ski wax) that may cover at least a portion of the upper support surface 144 of the left base portion 108 and the upper support surface 152 of the right base portion 112. Wax 748 may reduce friction between the upper support surfaces 144, 152 and the left and right foot support units 116, 124, which may improve their ability to slide across the upper support surfaces 144, 152. In some embodiments, another material, substance, or combination may be used to reduce friction.

Degrees of Freedom:

In some embodiments, the ski simulation and training device 100 may include: a base support assembly 104 comprising a left base portion 108 and a right base portion 112, a left foot support unit 116 adapted to receive and support a user's left foot 120, a right foot support unit 124 adapted to receive and support a user's right foot 128, a position measuring unit 132, a computing device 136, and a video display 140.

The left foot support unit 116 may be adapted to move independently of the right foot support unit 124. The left foot support unit 116 may be movable relative to the left base portion 108 in four or more degrees of freedom of movement relative to a ground support surface. The right foot support unit 124 may be movable relative to the right base portion 112 in four or more degrees of freedom of movement relative to a ground support surface 752. The degrees of freedom may include a first degree of freedom, a second degree of freedom, a third degree of freedom, and a fourth degree of freedom. The first degree of freedom may be a translation or freedom of movement in the lateral direction (e.g., left and right sideways movement) of either or both of the left foot support unit 116 and the right foot support unit 124 relative to the ground support surface. The second degree of freedom may be a translation or freedom of movement in the longitudinal direction (e.g., fore and aft movement) of either or both of the left foot support unit 116 and the right foot support unit 124 relative to the ground support surface. The third degree of freedom may be a rotational degree of freedom or a rotational movement (e.g., twisting) of either or both of the left foot support unit 116 and the right foot support unit 124 about an axis that is perpendicular to a ground support surface. The fourth degree of freedom is a rotational degree of freedom or a rotational movement (e.g., tilting) of either or both the left foot support unit 116 and the right foot support unit 124 about an axis that may be parallel to a ground support surface.

The left foot support unit 116 and the right foot support unit 124 may be capable of moving independently of one another in any of the degrees of freedom or movement types disclosed herein.

The left foot support unit 116 may be movable relative to the left base portion 108 in a fifth degree of freedom of movement relative to a ground support surface 752, wherein the fifth degree of freedom may be a translation or freedom of movement in vertical direction (e.g., an upward movement) of either or both of the left foot support unit 116 and the right foot support unit 124 relative to the ground support surface 752.

Each of the left foot support unit 116 and the right foot support unit 124 may permit three degrees of freedom of movement relative to a ground support surface 752, or three or more degrees of freedom of movement relative to a ground support surface 752, or four degrees of freedom of movement relative to a ground support surface 752, or four or more degrees of freedom of movement relative to a ground support surface 752, or five degrees of freedom of movement relative to a ground support surface 752, or five or more degrees of freedom of movement relative to a ground support surface 752. The foregoing degrees of freedom may collectively be referred to herein as degrees of freedom. Therefore, any use of the term degrees of freedom herein may refer to any of the foregoing numbers of degrees of freedom, i.e., three, three or more, four, four or more, five, five or more degrees of freedom).

In any embodiments disclosed herein, the left foot support unit 116 and the right foot support unit 124 may be capable of moving independently of one another in any of the degrees of freedom or movement types disclosed herein. In some embodiments, the degrees of freedom may include a first degree of freedom, a second degree of freedom, a third degree of freedom, a fourth degree of freedom, and a fifth degree of freedom.

In any embodiments disclosed herein, the first degree of freedom may be a translation or freedom of movement in the lateral direction (e.g., left and right sideways movement) of either or both of the left foot support unit 116 and the right foot support unit 124 relative to the ground support surface 752. In some embodiments, the second degree of freedom may be a translation or freedom of movement in the longitudinal direction (e.g., fore and aft movement) of either or both the left foot support unit 116 and the right foot support unit 124 relative to the ground support surface 752. In any embodiments disclosed herein, the third degree of freedom may be a rotational degree of freedom or a rotational movement (e.g., twisting) of either or both the left foot support unit 116 and the right foot support unit 124 about an axis that may be perpendicular to a ground support surface 752. In any embodiments disclosed herein, the fourth degree of freedom may be a rotational degree of freedom or a rotational movement (e.g., tilting) of either or both of left foot support unit 116 and the right foot support unit 124 about an axis that may be parallel to a ground support surface 752. In some embodiments, the optional fifth degree of freedom may be a translation or freedom of movement in vertical direction (e.g., an upward movement) of either or both of the left foot support unit 116 and the right foot support unit 124 relative to the ground support surface 752. In the fifth degree of freedom, the user 102 may be capable of lifting his or her left foot support unit 116 and/or right foot support unit 124 relative to the ground support surface 752, or increasing or decreasing an upward and/or downward force of his or her left foot support unit 116 and/or right foot support surface 144, 152.

Figure 20:
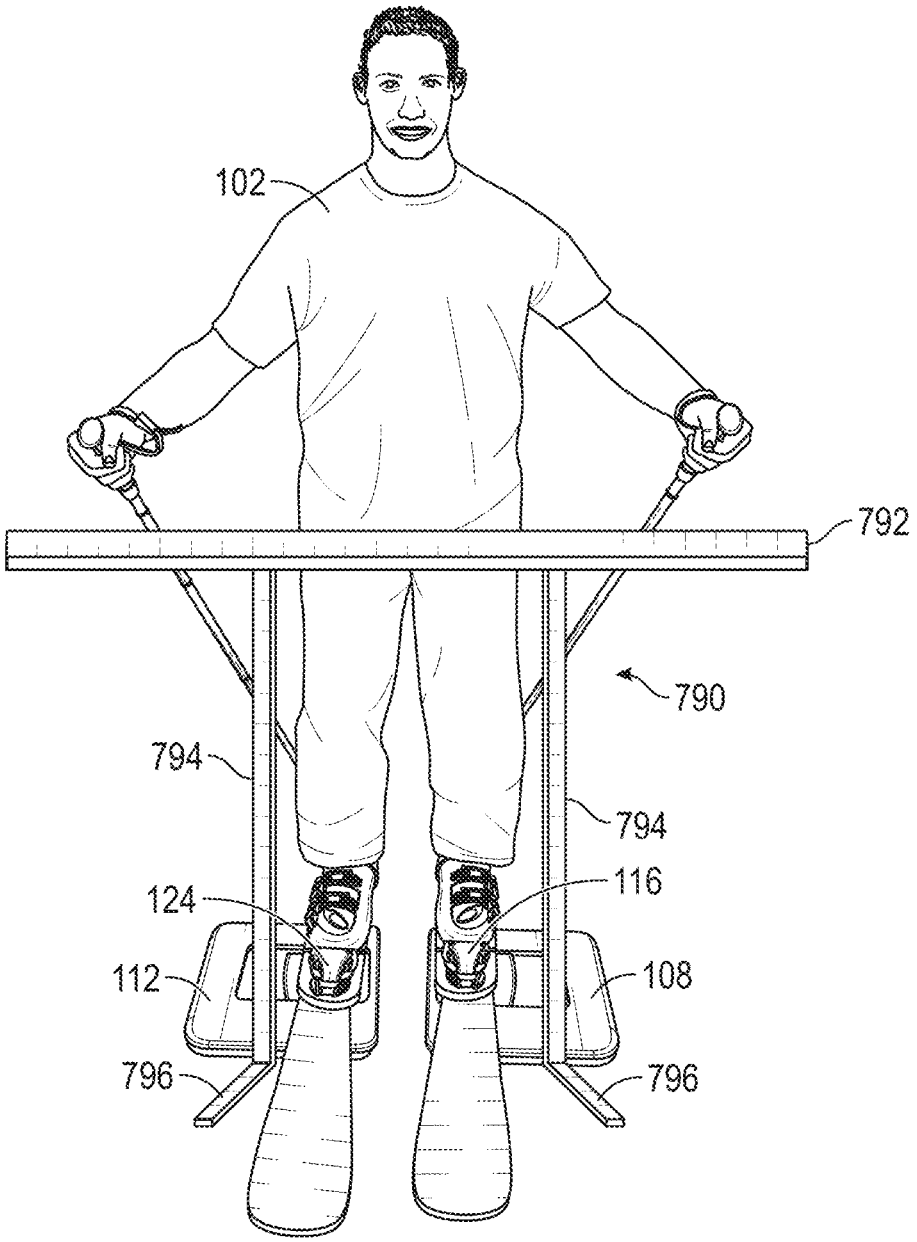
FIG. 20 illustrates a user using an embodiment of a ski simulation and training system.
Figure 21:
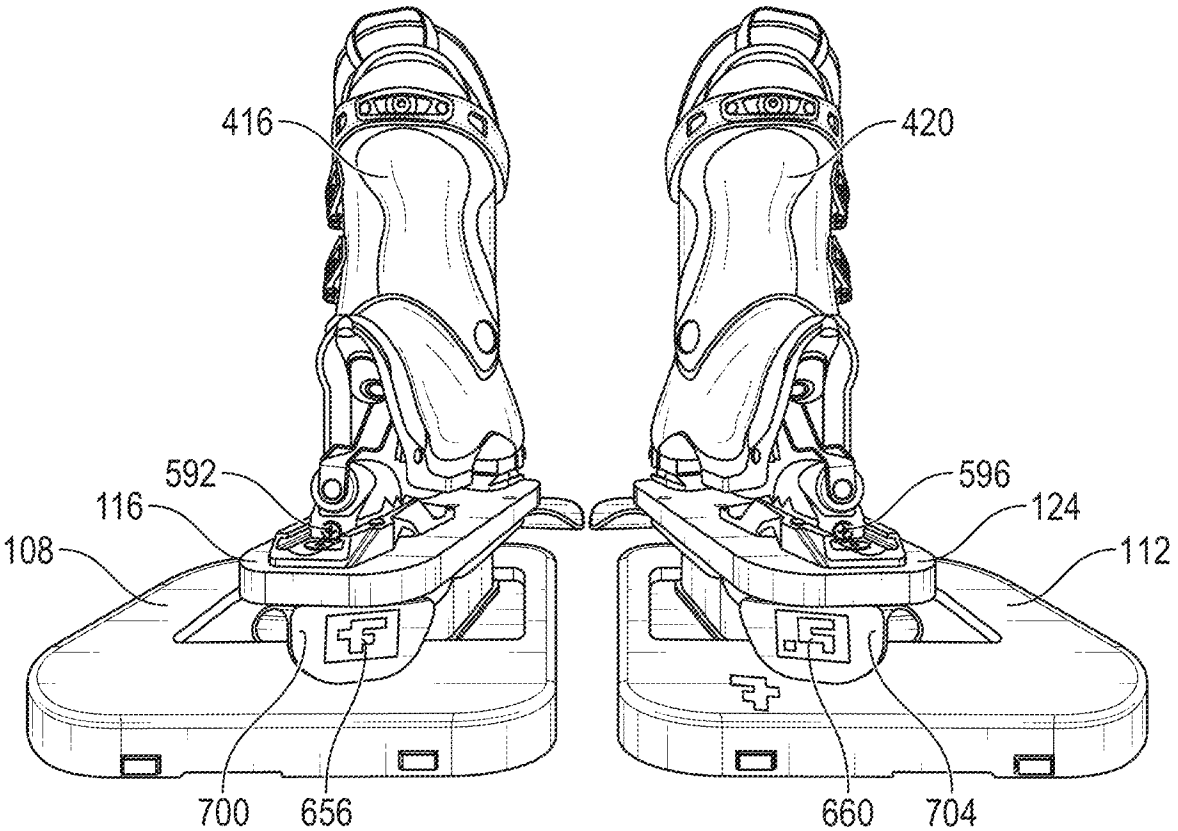
FIG. 21 illustrates left and right base portions and foot support units with corresponding left and right marker tags.

With reference to FIG. 20, any embodiments of the ski simulation and training device disclosed herein can have an optional support bar 790 that can be positioned in front of the user to provide more support for the user. The support bar 790 can include a cross-bar 792 that extends laterally in front of the user and that is supported by one or more (two being shown) vertical support bars 794 that extend upwardly from a ground surface. The one or more vertical support bars 794 can have base supports 796 that can be used to stabilize the support bar 790. In some embodiments, the support bar 790 can be adjustable so that a user can adjust a height of the cross-bar 792.

While certain examples have been described, these examples have been presented by way of example only and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure.

Features, materials, characteristics, or groups described in conjunction with a particular aspect, or example are to be understood to be applicable to any other aspect or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing examples. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations, one or more features from a claimed combination can, in some cases, be excised from the combination, and the combination may be claimed as a sub-combination or variation of a sub-combination.

Moreover, while operations may be depicted in the drawings or described in the specification in a particular order, such operations need not be performed in the particular order shown or in sequential order, or that all operations be performed, to achieve desirable results, unless provided otherwise herein. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some examples, the actual steps taken in the processes illustrated and/or disclosed may differ from those shown in the figures. Depending on the example, certain of the steps described above may be removed or others may be added. Furthermore, the features and attributes of the specific examples disclosed above may be combined in different ways to form additional examples, all of which fall within the scope of the present disclosure.

For purposes of this disclosure, certain aspects, advantages, and novel features are described herein. Not necessarily all such advantages may be achieved in accordance with any particular example. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain examples include, while other examples do not include, certain features, elements, and/or steps. Thus, such conditional language is not generally intended to imply that features, elements, and/or steps are in any way required for one or more examples.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain examples require the presence of at least one of X, at least one of Y, and at least one of Z.

Language of degree used herein, such as the terms "approximately," "about," "generally," and "substantially" represent a value, amount, or characteristic close to the stated value, amount, or characteristic that still performs a desired function or achieves a desired result.

The scope of the present disclosure is not intended to be limited by the specific disclosures of preferred examples in this section or elsewhere in this specification and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Although the foregoing invention has been described in terms of certain preferred embodiments, other embodiments will be apparent to those of ordinary skill in the art. Additionally, other combinations, omissions, substitutions, and modifications will be apparent to the skilled artisan, in view of the disclosure herein. Accordingly, the present invention is not intended to be limited by the recitation of the preferred embodiments but is instead to be defined by reference to the appended claims.

The terminology used in the description presented herein is not intended to be interpreted in any limited or restrictive manner and unless otherwise indicated refers to the ordinary meaning as would be understood by one of ordinary skill in the art in view of the specification. Furthermore, embodiments may comprise, consist of, consist essentially of, several novel features, no single one of which is solely responsible for its desirable attributes or is believed to be essential to practicing the embodiments herein described. As used herein, the section headings are for organizational purposes only and are not to be construed as limiting the described subject matter in any way. When definitions of terms in incorporated references appear to differ from the definitions provided in the present teachings, the definition provided in the present teachings shall control. It will be appreciated that there is an implied "about" prior to the temperatures, concentrations, times, etc. discussed in the present teachings, such that slight and insubstantial deviations are within the scope of the present teachings herein unless provided otherwise herein.

Although this disclosure is in the context of certain embodiments and examples, those of ordinary skill in the art will understand that the present disclosure extends beyond the specifically disclosed embodiments to other alternative embodiments and/or uses of the embodiments and obvious modifications and equivalents thereof. In addition, while several variations of the embodiments have been shown and described in detail, other modifications, which are within the scope of this disclosure, will be readily apparent to those of ordinary skill in the art based upon this disclosure. It is also contemplated that various combinations or sub-combinations of the specific features and aspects of the embodiments may be made and still fall within the scope of the disclosure. It should be understood that various features and aspects of the disclosed embodiments can be combined with, or substituted for, one another in order to form varying modes or embodiments of the disclosure. Thus, it is intended that the scope of the present disclosure herein disclosed should not be limited by the particular disclosed embodiments described above.

What is claimed is:

1. A ski simulation and training device for a user, the user having a left foot and a right foot, the ski simulation and training device comprising:

a base support assembly comprising a left base portion and a right base portion;

a left foot support unit adapted to receive and support the user's left foot; and a right foot support unit adapted to receive and support the user's right foot;

a position measuring unit;

a computing device; and a video display;

wherein:

the left foot support unit is adapted to move independently of the right foot support unit;

the left foot support unit is translatable relative to the left base portion in at least two directions about a left upper support surface of the left base portion so that the user can move their left foot in the at least two directions about the left upper support surface of the left base portion;

the left foot support unit is rotatable relative to the left base portion so that the user can rotate their left foot in a clockwise or counter-clockwise direction relative to the left base portion;

the left foot support unit is tiltable so that the user can tilt their left foot in a leftward direction or in a rightward direction relative to a first plane that is perpendicular to the left upper support surface of the left base portion;

the right foot support unit is translatable relative to the right base portion in at least two directions about a right upper support surface of the right base portion so that the user can move his or her right foot in the at least two directions about the right upper support surface of the right base portion;

the right foot support unit is rotatable relative to the right base portion so that the user can rotate their right foot in the clockwise or counter-clockwise direction relative to the right base portion;

the right foot support unit is tiltable so that the user can tilt their foot in the leftward direction or in the rightward direction relative to a second plane that is perpendicular to the right upper support surface of the right base portion;

the position measuring unit is adapted to, in an operable state, collect data that can be used by the computing device to determine at least the following:

a distance that the user's left foot is spaced apart in a lateral direction from the user's right foot;

a rotational orientation of the user's left foot;

a tilt angle of the user's left foot relative to the first plane that is perpendicular to the left upper support surface of the left base portion;

a rotational orientation of the user's right foot;

a tilt angle of the user's right foot relative to the second plane that is perpendicular to the right upper support surface of the right base portion; and the computing device is adapted to determine at least the following using the data from the position measuring unit: the distance that the user's left foot is spaced apart in the lateral direction from the user's right foot, the rotational orientation and the tilt angle of the user's left foot, and the rotational orientation and the tilt angle of the user's right foot.

2. The device of claim 1, wherein the computing device is adapted to cause the video display to display a visual depiction of at least a portion of a left ski and a portion of a right ski and wherein the computing device is adapted to illustrate a visual depiction of the rotational orientation and the tilt angle of the user's left foot and the user's right foot on the video display.

3. The device of claim 1, wherein the computing device is adapted to illustrate a visual depiction on the video display of a first virtual object in a rotational orientation and a tilt angle that corresponds to the rotational orientation and the tilt angle of the user's left foot or the user's right foot and a second virtual object, such as a ski or a portion of a ski, in a rotational orientation and a tilt angle that corresponds to the rotational orientation and the tilt angle of the other of the user's left foot or the user's right foot.

4. The device of claim 1, wherein the computing device is adapted to cause the video display to display a visual depiction that comprises at least a portion of a left ski that moves in response to and is consistent with a movement of the user's left foot and right ski that moves in response to and is consistent with a movement of the user's right foot.

5. The device of claim 1, wherein the video display depicts at least the portion of a left ski in a rotational orientation that simulates the rotational orientation of the user's left foot, the computing device depicts at least a portion of the right ski in a rotational orientation that simulates the rotational orientation of the user's right foot, and the computing device depicts at least the portion of the left ski at a distance from at least the portion of the right ski that corresponds to the distance that the user's left foot is spaced apart in the lateral direction from the user's right foot.

6. The device of any one of claim 5, wherein the video display depicts at least the portion of the left ski at a tilt angle that simulates the tilt angle of the user's left foot or left lower leg, and the computing device depicts at least the portion of the right ski at a tilt angle that simulates the tilt angle of the user's right foot or right lower leg.

7. The device of claim 1, wherein the left base portion is separate from and independently movable relative to the right base portion so that the left base portion can be moved relative to the right base portion and/or spaced apart from the right base portion.

8. The device of claim 1, wherein the left base portion comprises a left base support bottom member and a left base support cover coupled to the left base support bottom member and the right base portion comprises a right base support bottom member and a right base support cover coupled to the right base support bottom member, wherein the left base support bottom member has a perimeter wall around a perimeter of the left base support bottom member that is adapted to limit a range of movement of the left foot support unit in the lateral direction and in a longitudinal direction and wherein the right base support bottom member has a perimeter wall around a perimeter of the right base support bottom member that is adapted to limit a range of movement of the right foot support unit in the lateral direction and in the longitudinal direction, wherein the left base support cover comprises an opening in a top surface thereof through which a portion of the left foot support unit extends and the right base support cover has an opening in a top surface thereof through which a portion of the right foot support unit extends.

9. The device of claim 1, wherein the left base portion is mirror image of the right base portion.

10. The device of claim 1, wherein the at least two directions that the left foot support unit is adapted to move about the left upper support surface of the left base portion include a longitudinal direction and in the lateral direction and the at least two directions that the right foot support unit is adapted to move about the right upper support surface of the right base portion includes the longitudinal direction and in the lateral direction.

11. The device of claim 1, wherein the left foot support unit is adapted to rotate relative to the left upper support surface of the left base portion, said rotation relative to the left upper support surface of the left base portion being about a first axis that is perpendicular to the left upper support surface of the left base portion and wherein the right foot support unit is adapted to rotate relative to the right upper support surface of the right base portion, said rotation relative to the right upper support surface of the right base portion being about a second axis that is perpendicular to the right upper support surface of the right base portion.

12. The device of claim 1, wherein the left foot support unit is adapted to receive and/or couple with the user's left foot, a user's left shoe, or a user's left ski boot and the right foot support unit is adapted to receive or couple with the user's right foot, a user's right shoe, or a user's right ski boot.

13. The device of claim 1, wherein the left foot support unit is a mirror image of the right foot support unit.

14. The device of claim 1, wherein:

the left foot support unit comprises:

a left base plate configured to be supported against the left upper support surface of the left base portion; and a left tilt element coupled to the left base plate;

the right foot support unit comprises:

a right base plate configured to be supported against the right upper support surface of the right base portion; and a right tilt element coupled to the right base plate.

15. The device of claim 14, wherein the tilt element of the left foot support unit and the right foot support unit comprises a tilt base coupled to the base plate of the left foot support unit and a tilting member coupled to the tilt base, wherein:

the tilt base comprises an elongated channel along at least a portion of a length of an upper portion of the tilt base, the elongated channel facing generally upwardly when the tilt base is in an operable position;

the elongated channel comprises a semi-circular curved surface along a length of the elongated channel;

the tilting member has an elongated projection along at least a portion of a length of a lower portion of the tilting member, the elongated channel facing generally downwardly when the tilting member is in an operable position, wherein the elongated projection is configured to be received by the elongated channel of the tilt base in an operable position;

a shape of the elongated projection is complementary to a shape of the elongated channel; and the elongated projection of the tilting member is configured to slidably rotate within the elongated channel of the tilt base to permit the tilting member to tilt relative to the tilt base.

16. The device of claim 1, wherein the left foot support unit and the right foot support unit each comprises a ski binding adapted to receive a ski boot and wherein the left foot support unit is independently movable relative to the right foot support unit.

17. The device of claim 1, wherein the left foot support unit comprises a left sliding base portion adapted to translate about the left upper support surface of the left base support and a left tilting member coupled to the left sliding base portion, the left tilting member being adapted to tilt about ana first axis that is parallel to the left upper support surface of the left base portion, and wherein the right foot support unit comprises a right sliding base portion adapted to translate about the right upper support surface of the right base support and a right tilting member coupled to the right sliding base portion, the right tilting member being adapted to tilt about ana second axis that is parallel to the right upper support surface of the right base portion.

18. The device of claim 1, wherein the position measuring unit comprises a first marker tag positioned on the left foot support unit, a second marker tag positioned on the right foot support unit, and a camera, wherein the computing device is adapted to measure the position, the rotational orientation, and the tilt angle of the user's left foot based on a position, a rotational orientation, and a tilt angle of the first marker tag and is adapted to measure the position, the rotational orientation, and the tilt angle of the user's right foot based on a position, a rotational orientation, and a tilt angle of the second marker tag.

19. The device of claim 1, wherein the position measuring unit is further adapted to measure a position of the user's left foot and a position of the user's right foot.

20. A ski simulation and training device, comprising:

a base support assembly comprising a left base portion and a right base portion;

a left foot support unit adapted to receive and support a user's left foot; and a right foot support unit adapted to receive and support a user's right foot;

a position measuring unit;

a computing device; and a video display;

wherein:

the left foot support unit is adapted to move independently of the right foot support unit;

the left foot support unit is movable relative to the left base portion in four or more degrees of freedom of movement relative to a ground support surface;

the right foot support unit is movable relative to the right base portion in four or more degrees of freedom of movement relative to a ground support surface;

the degrees of freedom comprise a first degree of freedom, a second degree of freedom, a third degree of freedom, and a fourth degree of freedom;

the first degree of freedom is a translation or freedom of movement in a lateral direction of either or both of the left foot support unit and the right foot support unit relative to the ground support surface;

the second degree of freedom is a translation or freedom of movement in a longitudinal direction of either or both of the left foot support unit and the right foot support unit relative to the ground support surface;

the third degree of freedom is a rotational degree of freedom or a rotational movement of either or both of the left foot support unit and the right foot support unit about an axis that is perpendicular to a ground support surface; and the fourth degree of freedom is a rotational degree of freedom or a rotational movement of either or both of the left foot support unit and the right foot support unit about an axis that is parallel to a ground support surface.

* * * * *